US008496275B2

(12) United States Patent
Garneau et al.

(10) Patent No.: US 8,496,275 B2
(45) Date of Patent: Jul. 30, 2013

(54) ROTARY PAWL LATCH

(75) Inventors: Gregory Gilbert Garneau, Berlin, NJ (US); Evan Mengstab, Cheltenham, PA (US)

(73) Assignee: Southco, Inc., Concordville, PA (US)

( * ) Notice: Subject to any disclaimer, the term of this patent is extended or adjusted under 35 U.S.C. 154(b) by 804 days.

(21) Appl. No.: 12/401,580

(22) Filed: Mar. 10, 2009

(65) Prior Publication Data

US 2009/0235767 A1 Sep. 24, 2009

Related U.S. Application Data

(60) Provisional application No. 61/035,370, filed on Mar. 10, 2008.

(51) Int. Cl.
*E05C 3/06* (2006.01)

(52) U.S. Cl.
USPC ..... 292/201; 292/251.5; 292/144

(58) Field of Classification Search
USPC ..... 292/201, 144 X, 251.5
See application file for complete search history.

(56) References Cited

U.S. PATENT DOCUMENTS

| | | | |
|---|---|---|---|
| 2,767,571 | A | 10/1956 | Dingman et al. |
| 3,262,725 | A | 7/1966 | Ballantyne |
| 3,378,289 | A | 4/1968 | Beckman et al. |
| 3,394,957 | A | 7/1968 | Foley |
| 3,423,117 | A | 1/1969 | Klove, Jr. et al. |
| 3,572,793 | A | 3/1971 | Cole |
| 3,596,956 | A | 8/1971 | Yoshie |
| 3,666,307 | A | 5/1972 | Zaydel |
| 3,705,505 | A | 12/1972 | Landow et al. |
| 3,781,045 | A | 12/1973 | Watermann |
| 4,073,170 | A | 2/1978 | Miyabayashi et al. |
| 4,312,203 | A | 1/1982 | Davis |
| 4,492,395 | A | 1/1985 | Yamada |
| 4,538,845 | A | 9/1985 | Yamada |
| 4,544,189 | A | 10/1985 | Fiordellisi et al. |
| 4,561,690 | A | 12/1985 | Shinjo et al. |
| 4,575,138 | A | 3/1986 | Nakamura et al. |
| 4,624,491 | A | 11/1986 | Vincent |
| H358 | H | 11/1987 | Kaveney, Jr. |
| 4,813,722 | A | 3/1989 | Viscome et al. |
| 4,896,906 | A | 1/1990 | Weinerman et al. |
| 4,896,907 | A | 1/1990 | Hayakawa et al. |
| 4,921,286 | A | 5/1990 | Nakamura |
| 4,927,196 | A | 5/1990 | Girard et al. |
| 4,969,672 | A | 11/1990 | Childs et al. |
| 4,979,384 | A | 12/1990 | Malesko et al. |
| 5,007,261 | A | 4/1991 | Quantz |
| 5,069,491 | A | 12/1991 | Weinerman et al. |
| 5,163,723 | A | 11/1992 | Ruckert |
| 5,180,198 | A | 1/1993 | Nakamura et al. |
| 5,286,073 | A | 2/1994 | Ui |
| 5,299,844 | A | 4/1994 | Gleason |
| 5,584,206 | A * | 12/1996 | Ohta ..... 74/89 |
| 5,816,630 | A | 10/1998 | Bennett et al. |

(Continued)

FOREIGN PATENT DOCUMENTS

| | | | |
|---|---|---|---|
| WO | WO01/38671 | A2 | 5/2001 |

*Primary Examiner* — Carlos Lugo
*Assistant Examiner* — Mark Williams
(74) *Attorney, Agent, or Firm* — Paul & Paul

(57) ABSTRACT

A latch including a housing, a rotary pawl, catch means for releasably holding the pawl in a closed configuration, and means for operating the catch means are disclosed.

11 Claims, 57 Drawing Sheets

SECTION A - A

U.S. PATENT DOCUMENTS

| | | | | |
|---|---|---|---|---|
| 5,927,772 | A | 7/1999 | Antonucci et al. | |
| 6,381,999 | B1 * | 5/2002 | Doong | 70/107 |
| 6,471,260 | B1 | 10/2002 | Weinerman et al. | |
| 6,522,095 | B2 * | 2/2003 | Kachouh | 318/445 |
| 6,619,085 | B1 * | 9/2003 | Hsieh | 70/257 |
| 6,730,867 | B2 | 5/2004 | Hyp | |
| 6,761,382 | B2 | 7/2004 | Ji et al. | |
| 6,845,641 | B2 * | 1/2005 | Hsieh | 70/257 |
| 7,152,892 | B2 * | 12/2006 | Rechberg | 292/304 |
| 7,156,430 | B2 | 1/2007 | Hidding et al. | |
| 7,296,830 | B2 | 11/2007 | Koveal et al. | |
| 7,455,335 | B2 | 11/2008 | Garneau et al. | |
| 7,695,031 | B2 * | 4/2010 | Jackson et al. | 292/169 |
| 2008/0191494 | A1 | 8/2008 | Carabalona et al. | |
| 2008/0252083 | A1 | 10/2008 | Carabalona | |

* cited by examiner

SECTION C-C

SECTION E - E

SECTION A - A

SECTION A - A

SECTION A - A

SECTION C - C

SECTION A - A

SECTION C - C

SECTION A - A

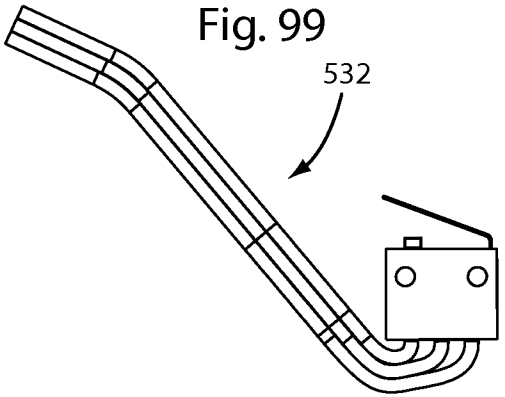
Fig. 99
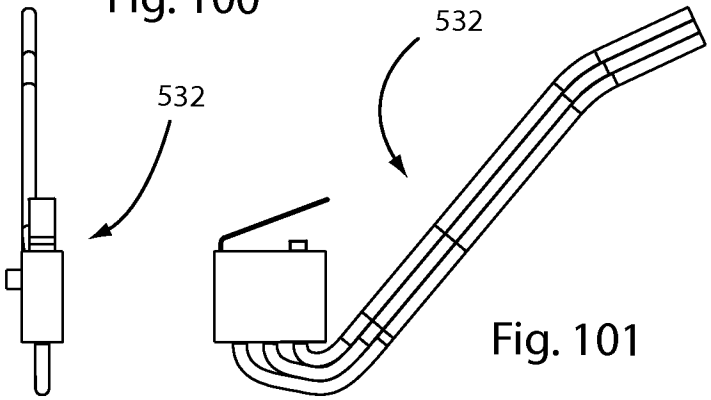
Fig. 100
Fig. 101
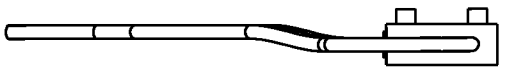
Fig. 102
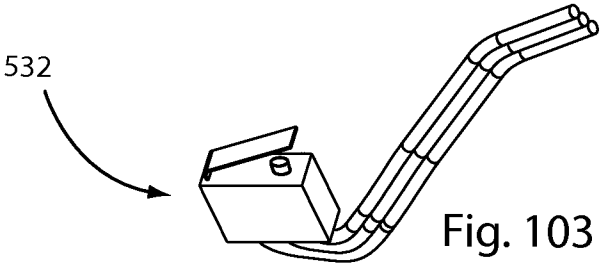
Fig. 103

ROTARY PAWL LATCH

CROSS REFERENCE TO RELATED APPLICATIONS

This application claims the priority of U.S. provisional application for patent No. 61/035,370, filed on Mar. 10, 2008, which is incorporated herein by reference in its entirety.

BACKGROUND OF THE INVENTION

1. Field of Invention

The present invention relates to the field of latch assemblies.

2. Brief Description of the Related Art

Latch assemblies are relied on in many applications for securing items, such as panels, doors, and doorframes together. For example, containers, cabinets, closets, drawers, compartments and the like may be secured with a latch. Furthermore, in many applications an electrically operated latch is desirable due to the need for remote or push-button entry, coded access, key-less access, or monitoring of access. Various latches for panel closures have been employed where one of the panels such as a swinging door, drawer or the like is to be fastened or secured to a stationary panel, doorframe, cabinet, or compartment body. Although many latch assemblies are known in the prior art, none are seen to teach or suggest the unique features of the present invention or to achieve the advantages of the present invention.

SUMMARY OF THE INVENTION

The present invention is directed to a latching system for securing two members together. The present invention includes a housing, a rotary pawl, catch means for releasably holding the pawl in a closed position, and actuation means for selectively moving the catch means out of engagement with the pawl. The pawl is pivotally attached to the housing and is rotationally movable between a closed or engaged position and an open or disengaged position. The pawl is provided with a torsion spring member that biases the pawl toward the open or disengaged position. The catch means includes a catch member that is pivotally movable between an engaged position and a disengaged position and is spring biased toward the engaged position. The catch member can be disengaged, in other words moved to the disengaged position, by the action of the actuation means, which in the illustrated example is a motorized plunger. When the pawl strikes a keeper during closing, the pawl is moved to the closed position. An elongated arm projecting from the main body of the pawl is engaged by the catch member once the pawl is in the closed position in order to keep the pawl in the closed position. At this time the pawl captures the keeper to secure the latch to the keeper. The actuation means includes a motor, a reduction gear system, a rotary cam, and a plunger. Energizing the motor pushes the catch member to the disengaged position, which allows the pawl to rotate under the force of the torsion spring to the open position. Thus, the latch can be disengaged from the keeper and a door or drawer, for example, can be opened.

BRIEF DESCRIPTION OF THE DRAWINGS

FIGS. 99-103 are views of a micro-switch that signals that the latch assembly is in the open configuration used in the latch assembly of FIG. 1.

DETAILED DESCRIPTION OF THE INVENTION

Figure 1:
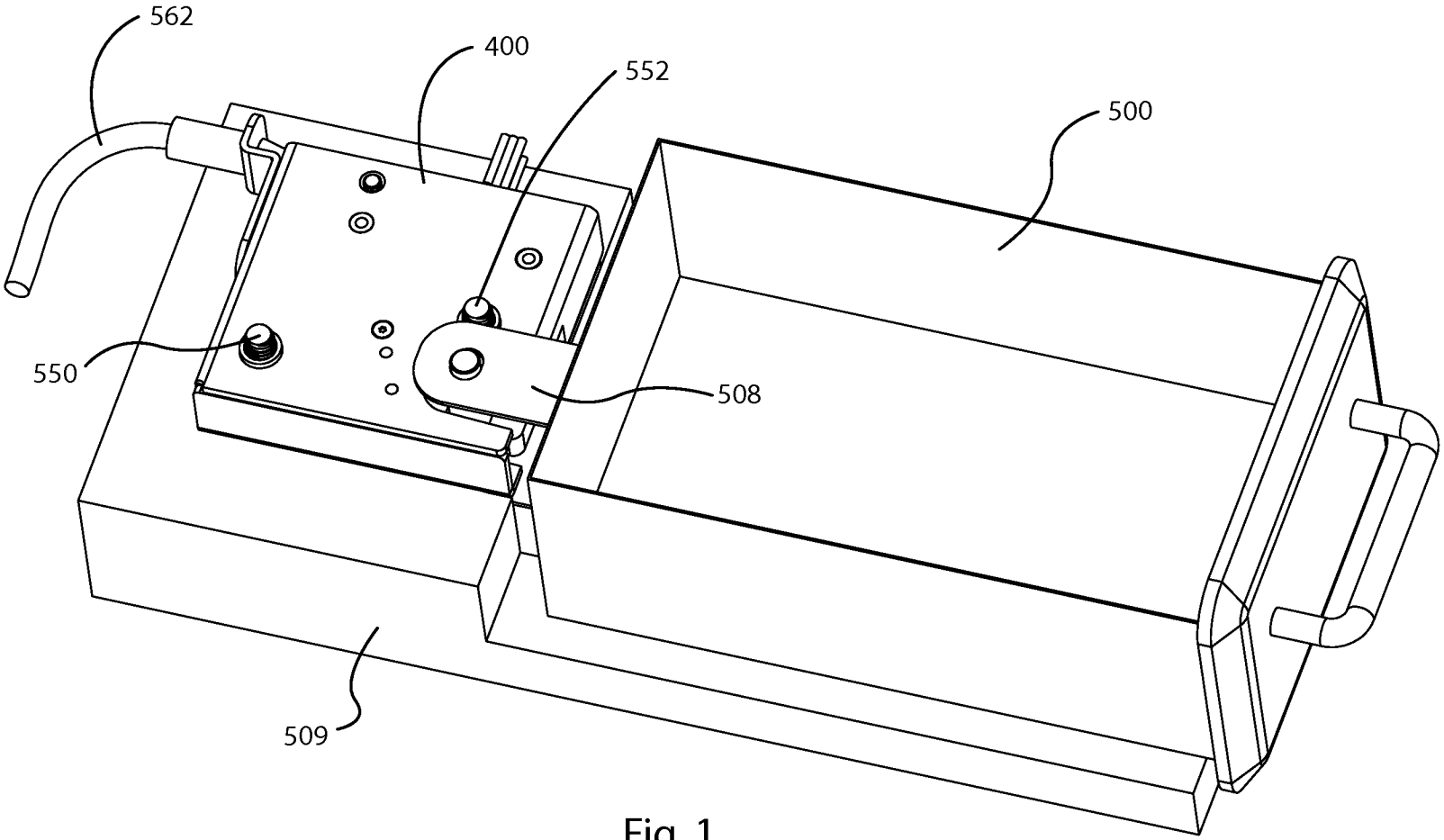
FIG. 1 is an environmental view of an embodiment of a latch assembly according to the present invention shown in the latched configuration.
Figure 2:
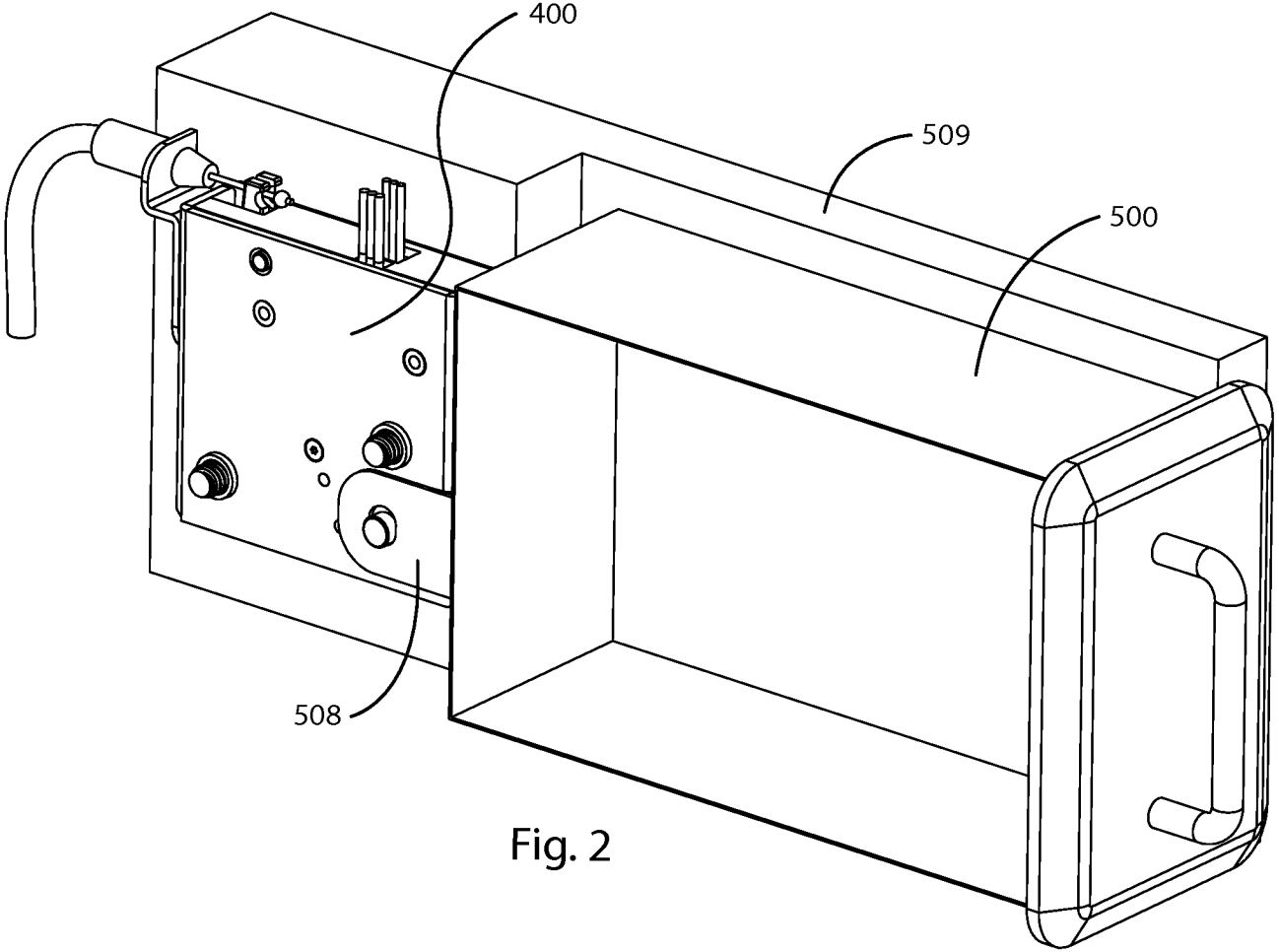
FIG. 2 is another environmental view of the latch assembly of FIG. 1 shown in the latched configuration.
Figure 3:
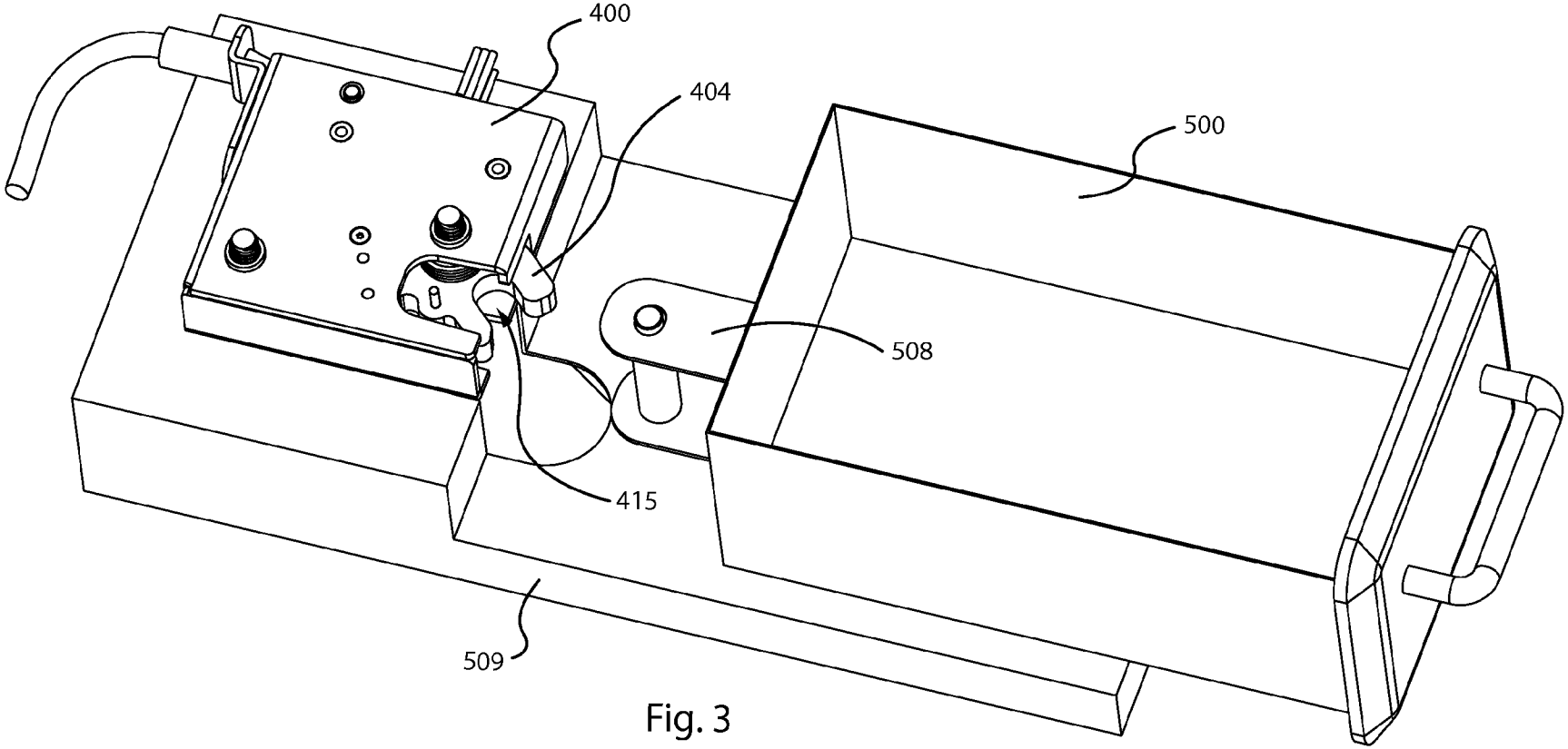
FIG. 3 is an environmental view of the latch assembly of FIG. 1 shown in the unlatched configuration.
Figure 4:
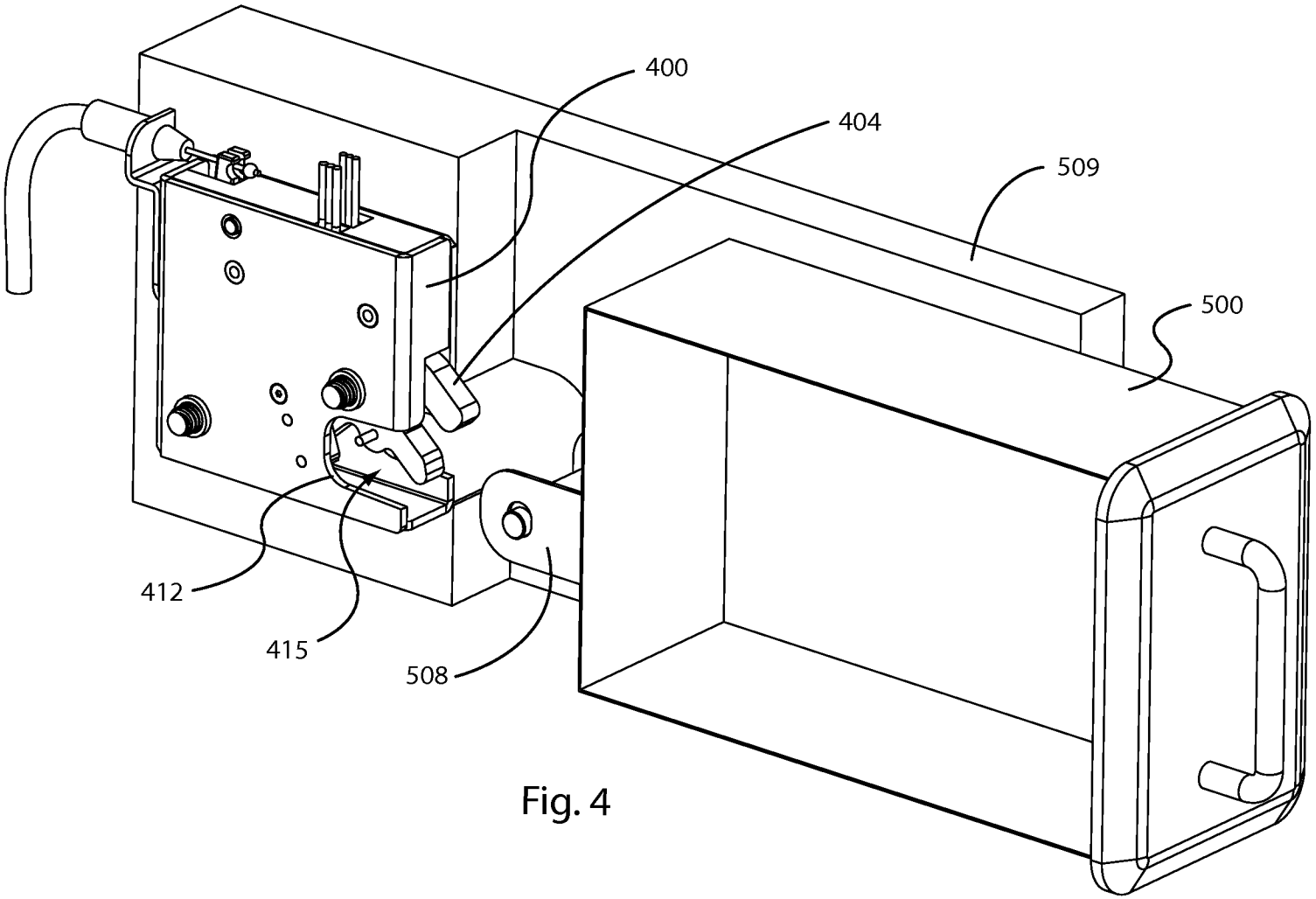
FIG. 4 is another environmental view of the latch assembly of FIG. 1 shown in the unlatched configuration.
Figure 5:
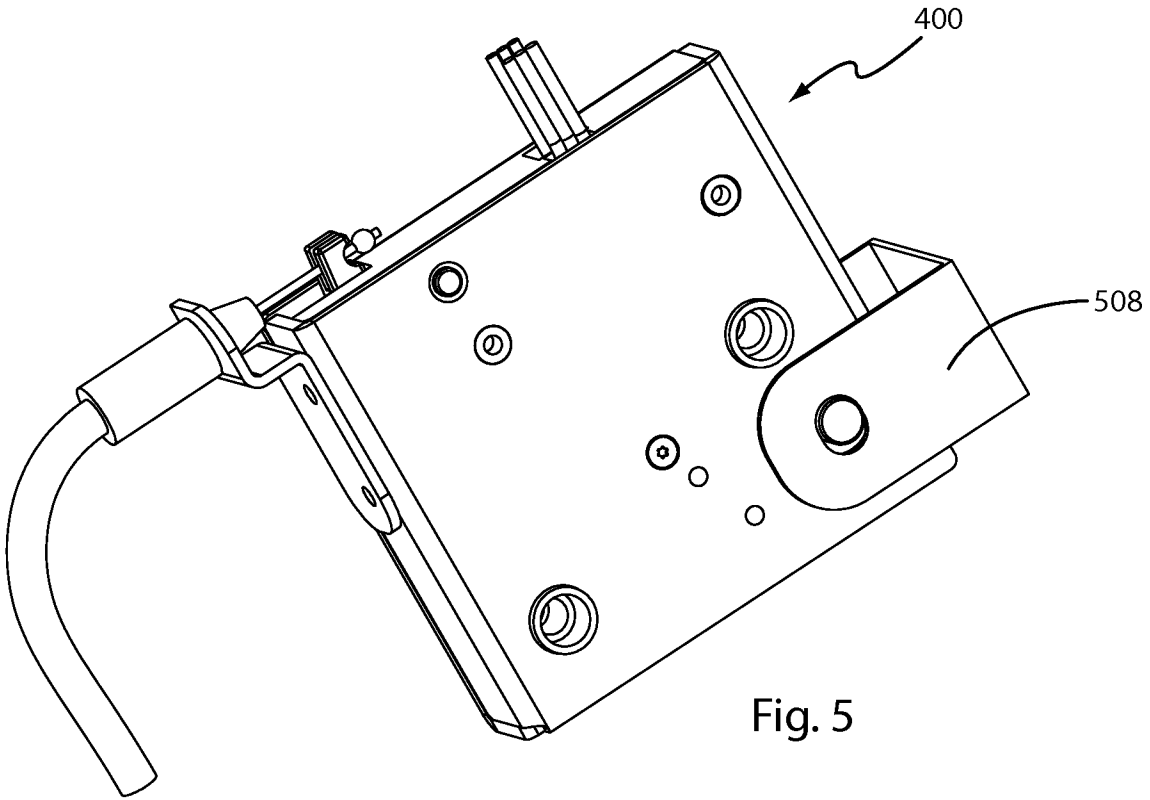
FIGS. 5-15 are views of the latch assembly of FIG. 1 shown in the latched configuration.
Figure 6:
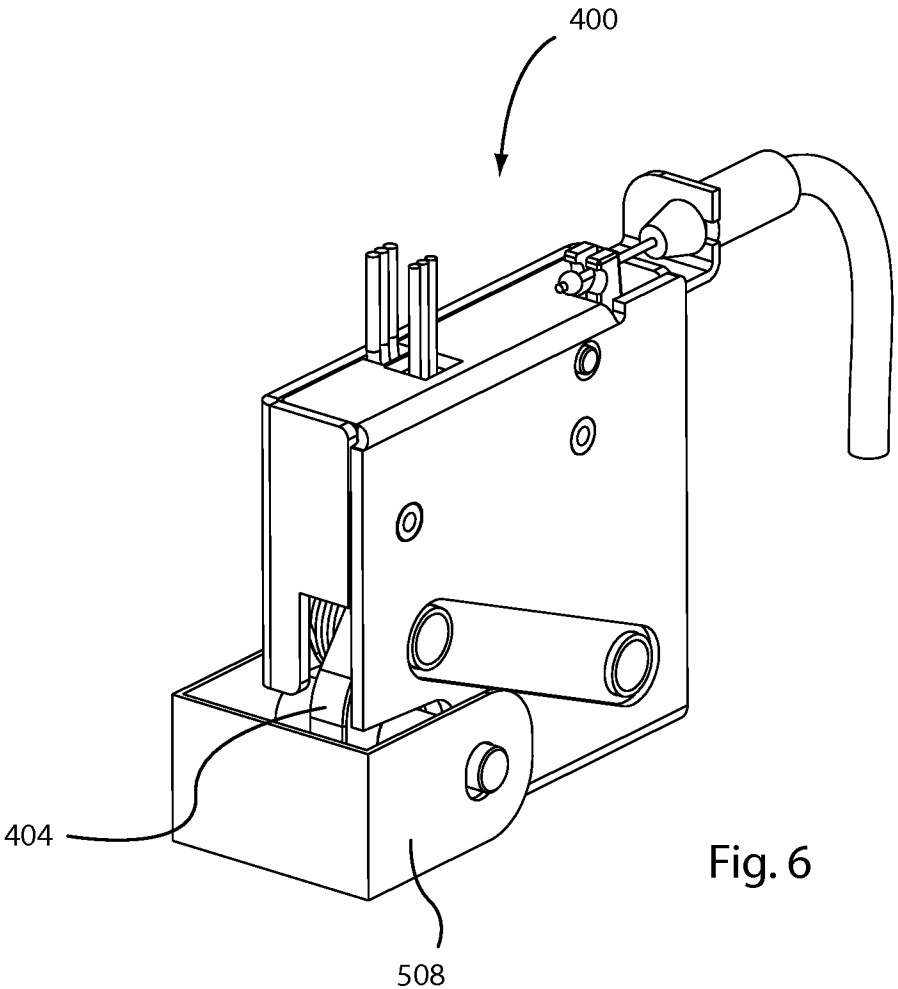
Figure 7:
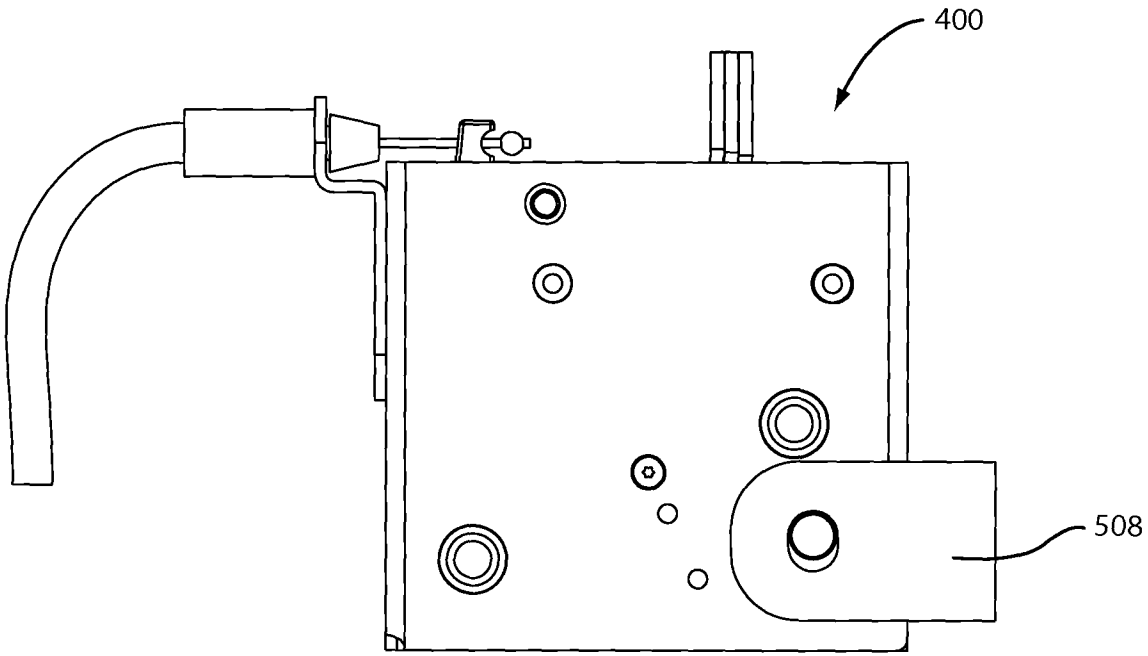
Figure 8:
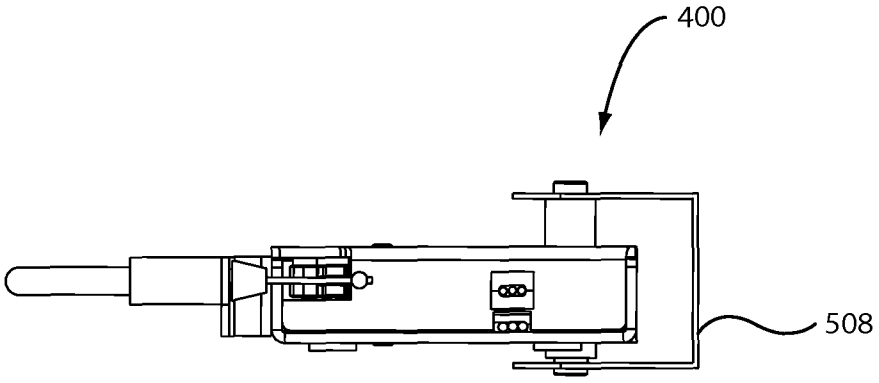
Figure 104:
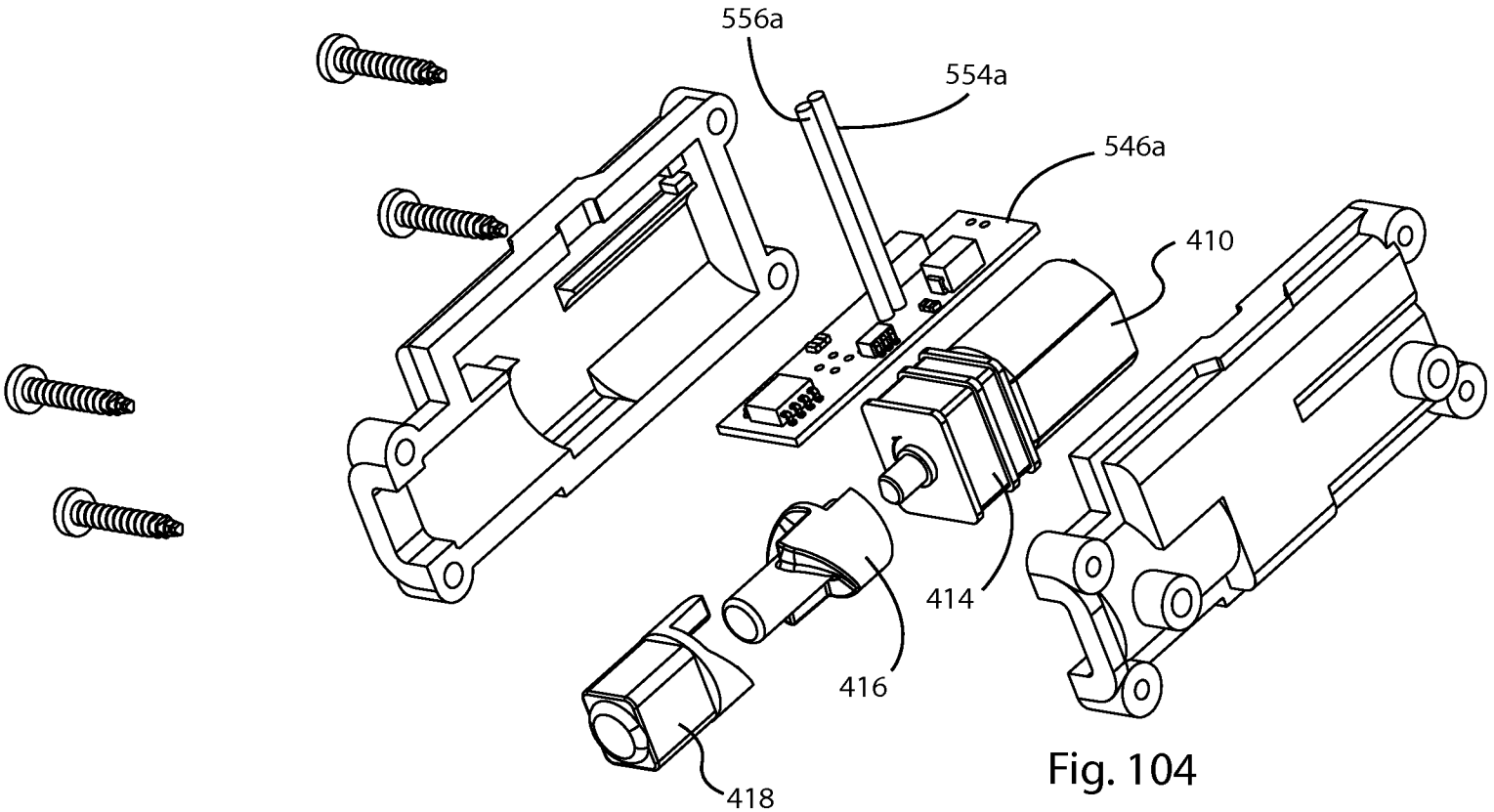
FIG. 104 is an exploded view of an alternative motorized drive mechanism for use with the latch assembly of FIG. 1.

Referring to FIGS. 1-104, a latch 400 in accordance with the present invention can be seen. The latch 400 includes a latch housing 402, a pawl 404, a catch or trigger 406, and actuation means for selectively moving the catch or trigger out of engagement with the pawl. In the illustrated embodiment, an electrically operated actuator assembly 408 serves as the actuation means for selectively moving the trigger out of engagement with the pawl.

The latch 400 is generally applicable wherever one or more closure members need to be secured in a certain position. The latch 400 can be used together with the striker 508 to secure any two closure members together. In the illustrated example, the latch 400 is shown being used for securing a drawer 500 relative to a cabinet 509 (only the portion of the cabinet supporting the drawer and the latch 400 is shown). Further, the latch 500 can be mounted to either the movable member or the stationary member. In addition, the latch 400 may be mounted in any orientation depending upon the particular application.

In the illustrated embodiment, the housing 402 is formed by a first plate 403 and a second plate 401 that receive the various components of latch 400 between them. In the illustrated embodiment, the second plate of the housing 402 acts as a cover plate 401, and the second plate of the housing 402 acts as a base plate 403. Furthermore, the housing must be adapted to allow an unobstructed path to the pawl slot 458 when the pawl 404 is in the open position. The housing 402 has an opening 415 that allows at least a portion of the striker 508 to enter the housing 402 for engagement by the pawl 404. In the illustrated example, the opening 416 is formed by slots 412, 413 provided in registry with each other in the cover plate 401 and the base plate 403 of the housing, respectively. The slots 412, 413 form an open, approximately U-shaped indentation or recess in the housing 402 as viewed in profile. The slots 412, 413 allow at least a portion of the striker 508 to enter the housing 402 for engagement and capture by the pawl 404. The slots 412, 413 allow an unobstructed path to the pawl slot 458 when the pawl 404 is in the open position. The slots 412, 413 are sized such that the housing 402 will not interfere with the movement of the striker 508 relative to the housing 402 as the pawl 404 is moved from the open position to the closed position by contact with the striker 508.

The electrically operated actuator assembly 408 includes a motor 410, a reduction gear system 414, a cam 416, and a plunger 418. In the illustrated embodiment, the output shaft of the motor 410 is engaged to the reduction gear system 414 such that it provides a motive force or an input torque to the reduction gear system 414 when the motor is energized. The motive force or input torque provided by the motor is rotational and imparts rotation to the gear wheels (not shown) of the reduction gear system 414. The operation of a reduction gear system and the interconnection between a reduction gear system and a motor output shaft are well known and therefore are not discussed in detail. Accordingly, the output shaft of the motor rotates in response to the motor being energized and in turn causes the output shaft 420 of the reduction gear system 414 to rotate. By a reduction gear system it is meant that the output shaft of the motor must rotate several times or more for each rotation of the output shaft 420 of the reduction gear system 414. This arrangement reduces the torque output and consequently the size of the motor 410 required for the proper operation of the latch 400. The motor 410, the reduction gear system 414, the cam 416, and the plunger 418 are received in their own housing 421, which in turn is installed in the latch housing 402. The cam 416 is attached to the output shaft 420 of the reduction gear system 414. The cam 416 has a pair of ramps 424 that each extend along a spiral path for approximately 180° or less about a central shaft 422 of the cam 416. The ramps 424 both rise in the same direction of rotation. The cam 416 also has a receptacle 423 that receives the output shaft 420 of the reduction gear system 414 in a manner such that the cam 416 rotates with the output shaft 420 as a unit during normal operation of the latch 400. For example, the receptacle 423 and the output shaft 420 may have mating non-circular cross sections such that no relative rotation can occur between the receptacle 423 and the output shaft 420 and thus between the cam 416 and the output shaft 420.

The plunger 418 includes a pair of ramps 426 that are substantially like the ramps 424. The ramps 426 are received between the ramps 424 when the plunger 418 is in the retracted position such that the apex 425 of each ramp 426 seats against the bottom 427 of each ramp 424. The plunger 418 has a receptacle 429 that telescopically receives the central shaft 422 of the cam 416 to help guide the rectilinear motion of the plunger 418 between its extended and retracted positions. The plunger 418 has a plunger shaft portion 540 that has a non-circular cross section and is received at least in part within the mating non-circular opening 542 of the actuator housing 421. This arrangement prevents relative rotation between the plunger 418 and the actuator housing 421, while allowing the plunger 418 to move rectilinearly between its retracted position and its extended position where it projects out of the actuator housing 421. Non-circular as used herein includes any shape other than a perfect circle and includes a circle interrupted by a groove or a flat planar surface. In the illustrated example, the opening 542 and the plunger shaft 540 are rectangular in cross section.

The central longitudinal axes of the cam 416, the plunger 418 and the motor 410 are coincident in the illustrated embodiment. The axis of rotation of the pawl 404 is offset to one side of the longitudinal axes of the cam 416, the plunger 418 and the motor 410.

When the motor 410 is energized, the cam 416 rotates causing the ramps 426 to ride up the ramps 424, given that the plunger 418 cannot rotate, such that the plunger 418 will move from its retracted position toward its extended position until the apex of each ramp 426 reaches the apex 544 of each ramp 424 where the plunger 418 reaches its extended position and pushes the catch 406 to release the pawl 404 from its closed position. Further rotation of the cam 416 brings the bottoms 427 of the ramps 424 into registry with the apexes 425 of the ramps 426 and the plunger 418 is free to move back to its retracted position. At this point the control circuitry on the circuit board 546 shuts off power to the motor 410 stopping further rotation of the cam 416. The catch 406, due to the bias of the catch spring 488, pushes the plunger 418 back to its retracted position and the latch 400 is again ready to repeat its operating cycle.

The latch assembly 400 also includes a pawl 404 shown pivotally connected to the latch housing 402 with suitable attachment means such as the pawl pivot pin 438 that passes through the hole 440 in the pawl 404. The cover plate 401 and the base plate 403 of the housing 402 are each provided with a hole 432 and 433 for receiving the ends of the pivot pin 438 as the plates 401 and 403 are assembled together. Thus, the pawl 404 is rotationally supported by the housing 402.

The pawl 404 has an elongated arm 454 provided for engagement by the trigger 406. The trigger 406 has a catch surface 548 that can catch the tip of the arm 454 and hold the pawl 404 in its closed position. The long arm 454 reduces the frictional force between the catch 406 and the pawl 404 due to the reaction force caused by the torque imparted to the pawl by the pawl torsion spring 462. This in turn reduces the torque and power output required of the motor 410, which allows further reductions in motor and latch size and ultimate latch cost.

The pawl 404 is provided with a pawl slot 458 to retain the striker 508 when the pawl 404 is in the latched or closed position. In the illustrated example, the striker 508 has a rod-shaped portion 434 that engages the pawl slot 458 as the panel 500 is moved to the closed position relative to the compartment 509. When the panel 500 is closed, the rod-shaped portion 434 of the striker 508 will be positioned or caught in the pawl slot 458 with the pawl 404 in the latched position.

A pawl torsion spring 462 is installed in the housing 402 with the coiled portion 464 of the torsion spring 462 surrounding the pivot pin 438. An arm 468 of the torsion spring 462 engages a hole 460 in the pawl 404. The torsion spring 462 also has a second arm 472 that engages the housing 402.

With the arm 472 of the torsion spring 462 in engagement with the wall 466 of the housing 402, the arm 468 of the torsion spring 462 exerts a force on the pawl 404 that biases the pawl 404 toward the open or unlatched position.

The trigger 406 is in the form of an elongated lever that is pivotally supported in the housing 402 near one of its ends. The pivot axis of the trigger 406, as defined by the trigger pivot pin 470, is parallel to the pivot axis or axis of rotation of the pawl 404. Furthermore, the pivot axis of the trigger 406, as defined by the trigger pivot pin 470, is spaced apart from the pivot axis or axis of rotation of the pawl 404. The trigger 406 is pivotally movable between an engaged position and a disengaged position and is spring biased toward the engaged position. A trigger spring 488 is provided for biasing the trigger 406 toward the engaged position. The trigger spring 488 is a torsion spring and has a coiled portion 474, a first arm 476, and a second arm 478. The trigger spring 488 is installed in the housing 402 with the coiled portion 474 of the torsion spring 488 surrounding the trigger pivot pin 470. The arm 476 of the torsion spring 488 engages the hole 482 in the trigger 406. The second arm 478 of the torsion spring 488 engages the housing 402.

The trigger 406 engages the pawl arm 454 at a point intermediate its pivot axis and the location on the trigger 406 where the plunger 418 contacts the trigger 406. This arrangement provides a mechanical advantage to the plunger 418 due to the long lever arm afforded by the trigger 406. Once again, this arrangement reduces the torque and power output required of the motor 410, which allows further reductions in motor and latch size and ultimate latch cost.

The trigger pivot pin 470 passes through a hole in the trigger 406 near one end of the trigger 406. The trigger 406 engages the arm 454 to hold the pawl 404 in the latched position when the trigger 406 is in the engaged position. As the plunger 418 moves from the retracted to the extended position, the plunger 418 engages the trigger 406 to pivotally move the trigger 406 to the disengaged position where the trigger 406 no longer engages the pawl 404. When the trigger 406 is in the disengaged position, the pawl 404 is free to rotate under spring bias to the unlatched position. The rod-shaped portion of the striker 508 can now be withdrawn from the pawl slot 458 and the drawer 500 can be moved to the open position.

The trigger spring 488 biases the trigger 406 toward the engaged position where the trigger 406 will tend to reengage the pawl 404 if the pawl 404 is rotated to the latched position. If the drawer 500 is again moved to the closed position relative to the cabinet 509, the rod-shaped portion of the striker 508 will impact the pawl slot 458 and cause the rotation of the pawl 404 to the latched position. Once the pawl 404 is in the latched position, the pawl can again be engaged by the trigger 406 to thereby retain the pawl in the latched position and secure the drawer 500 in the closed position.

Figure 9:
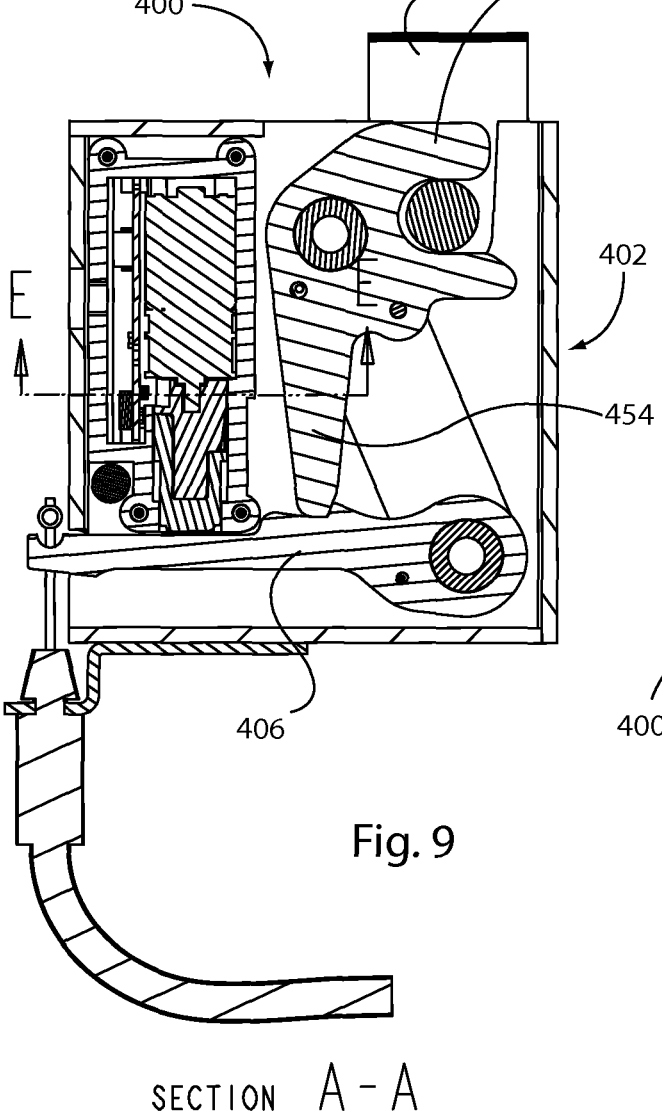
Figure 10:
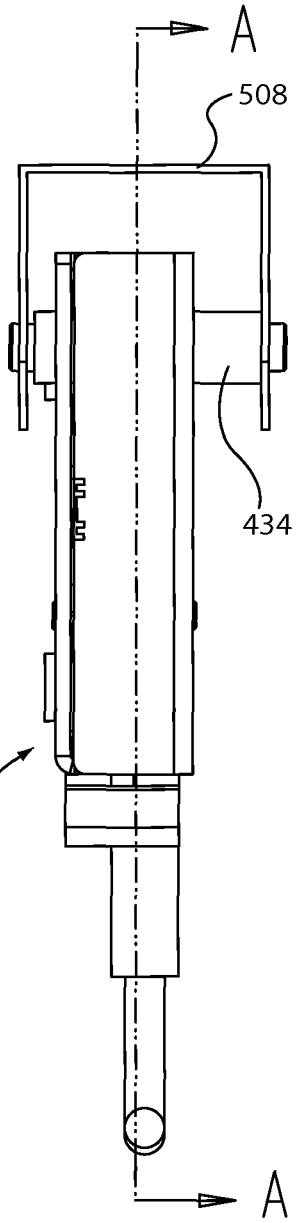
Figure 11:
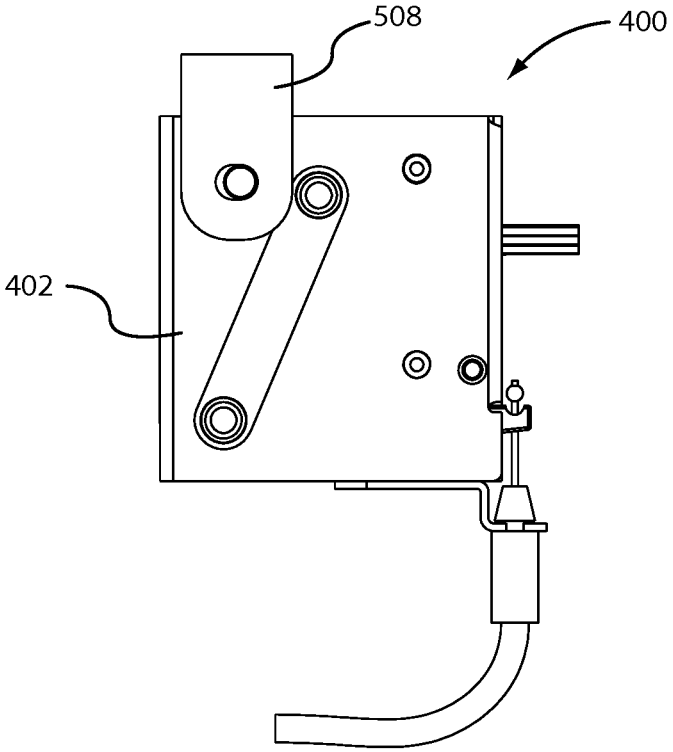
Figure 12:
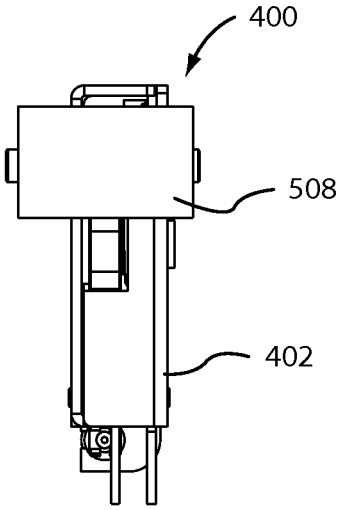
Figure 13:
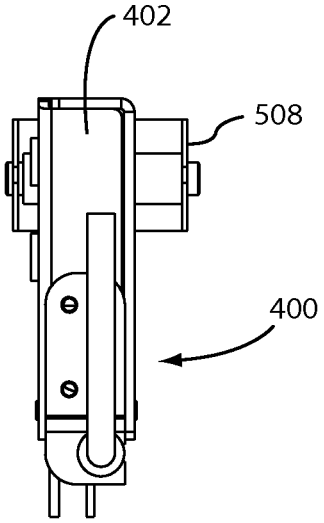
Figure 14:
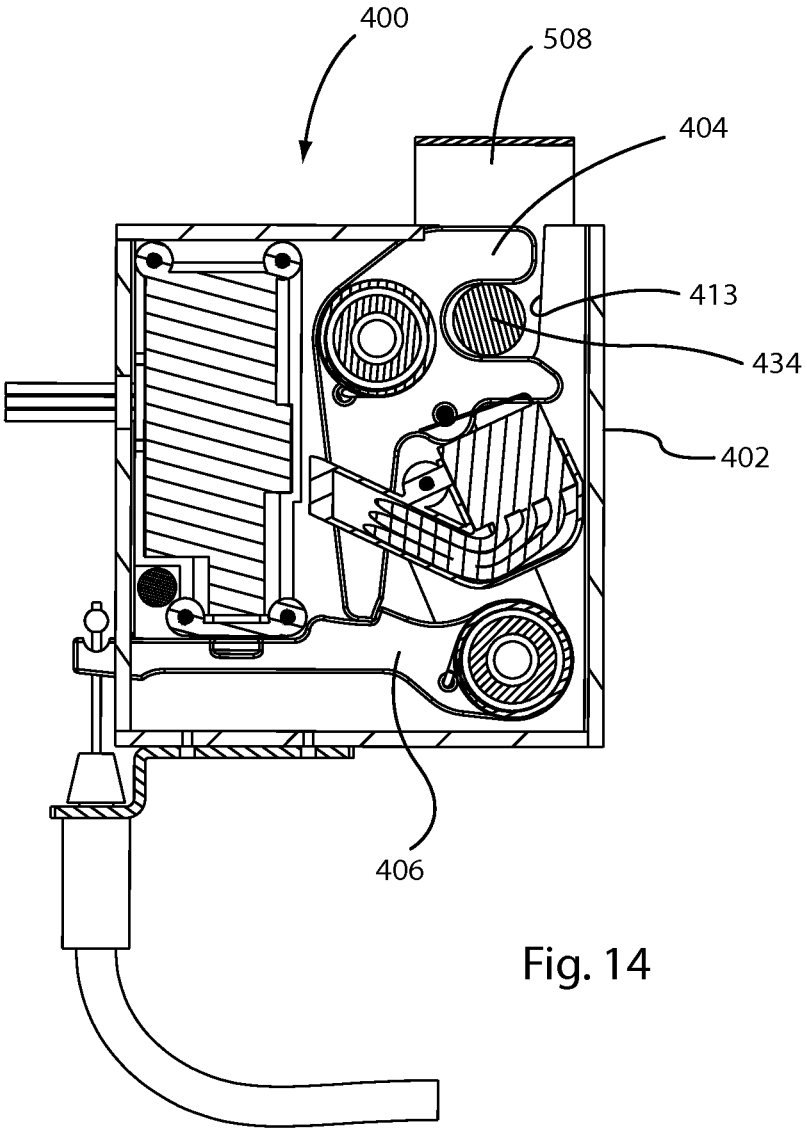
Figure 15:
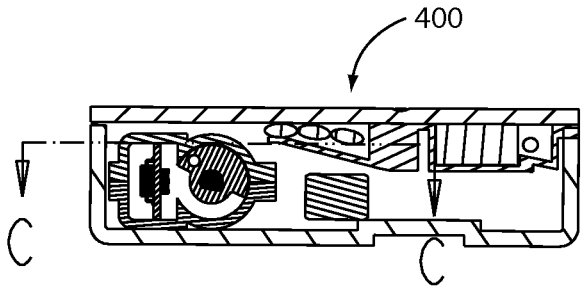
Figure 16:
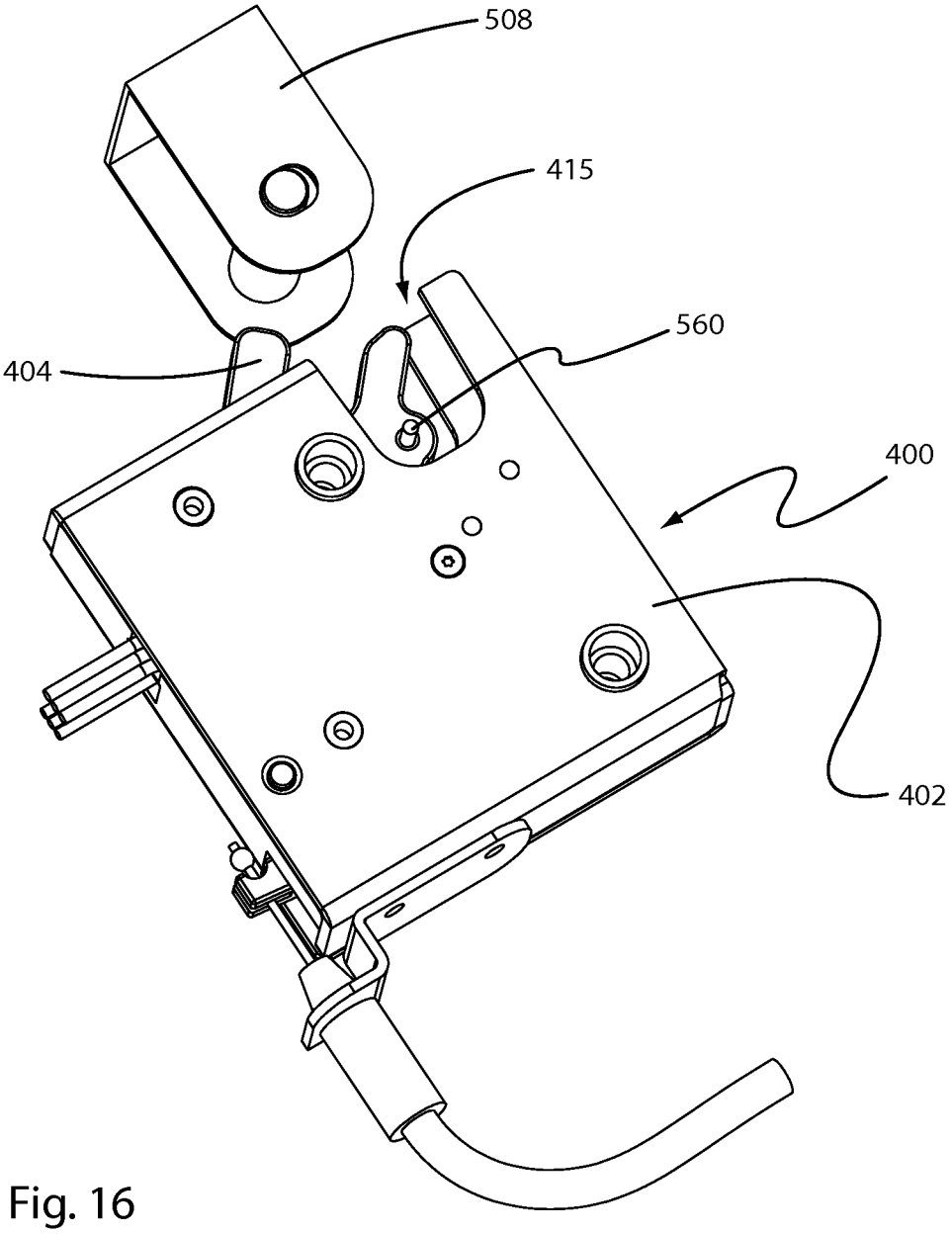
FIGS. 16-24 are views of the latch assembly of FIG. 1 shown in the latched configuration.
Figure 17:
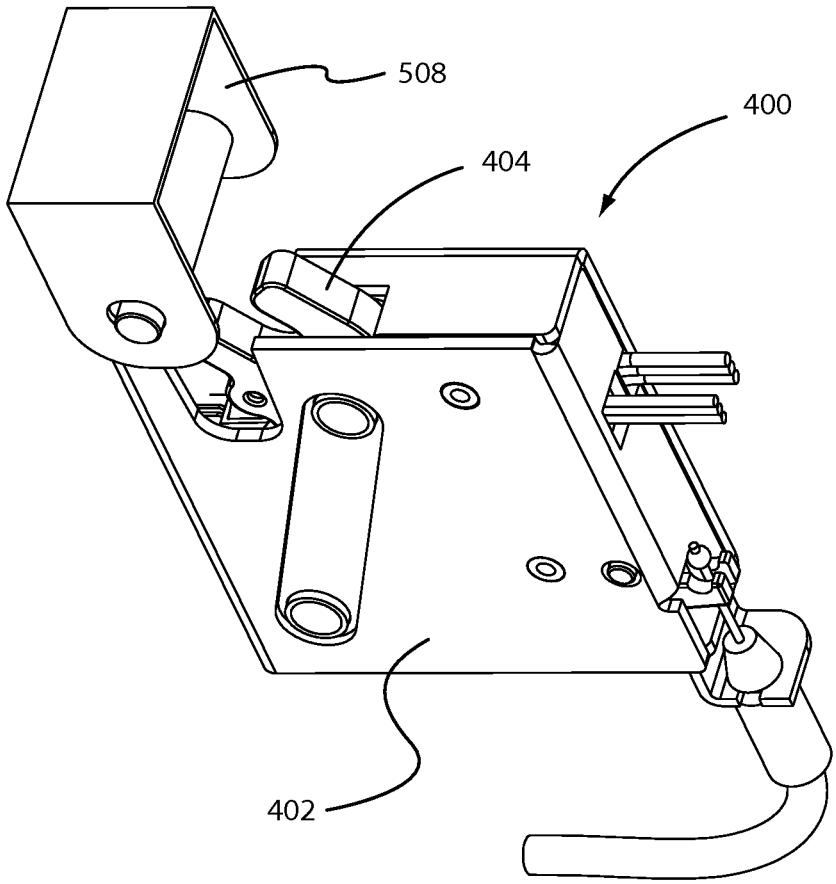
Figure 18:
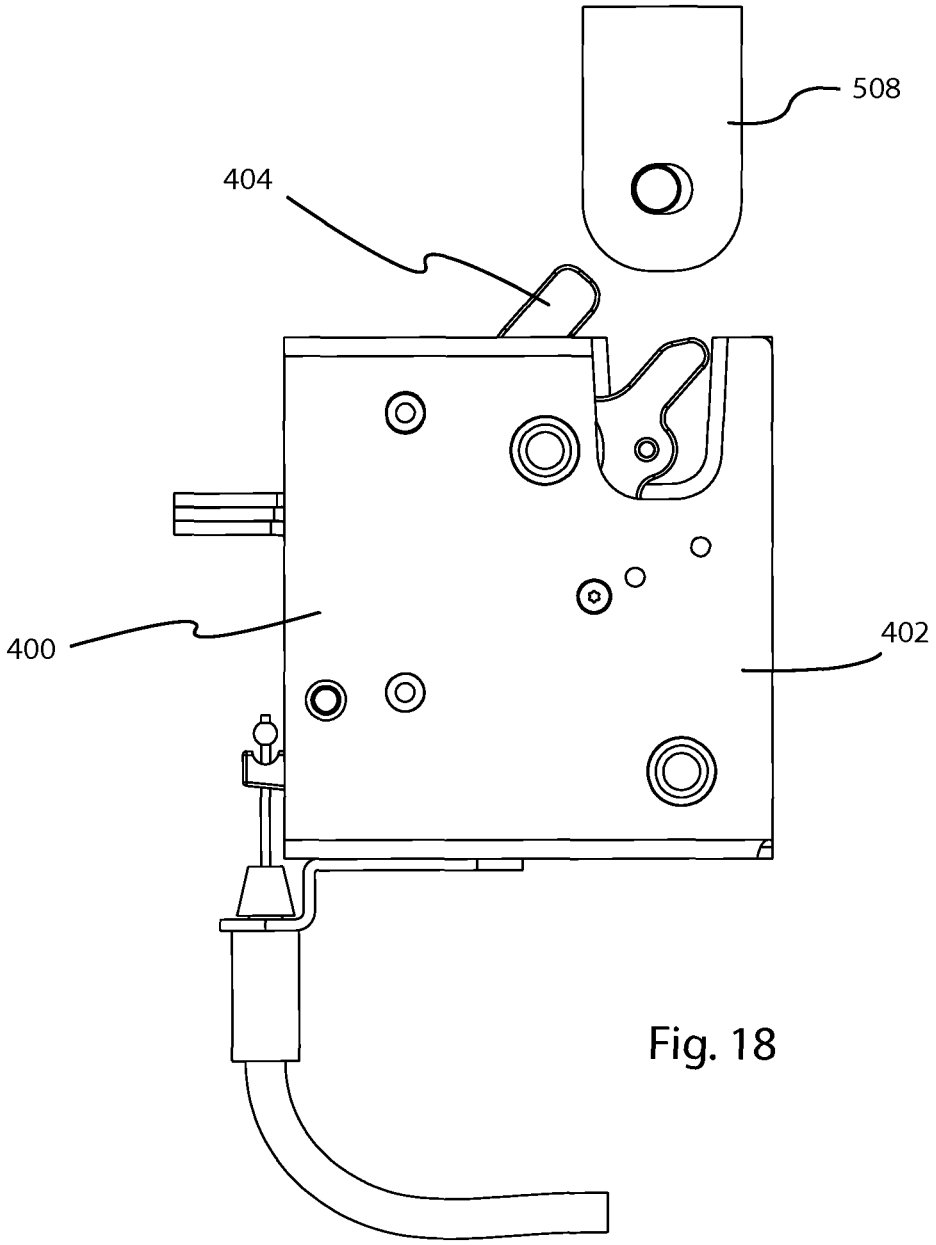
Figure 19:
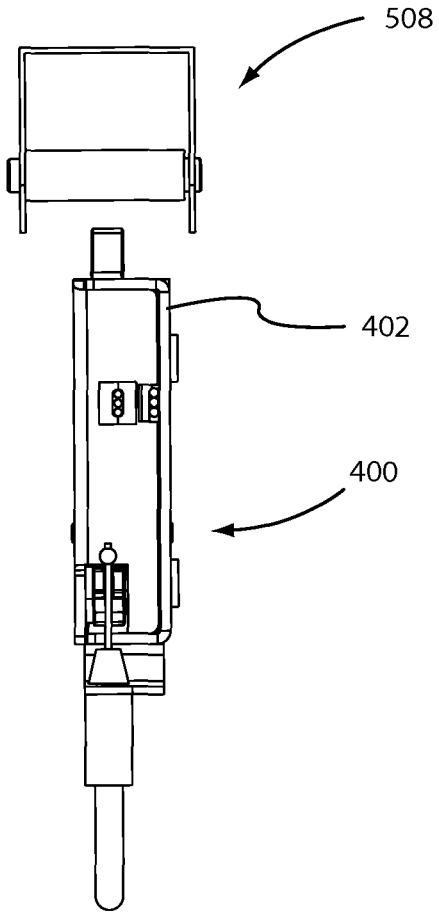
Figure 20:
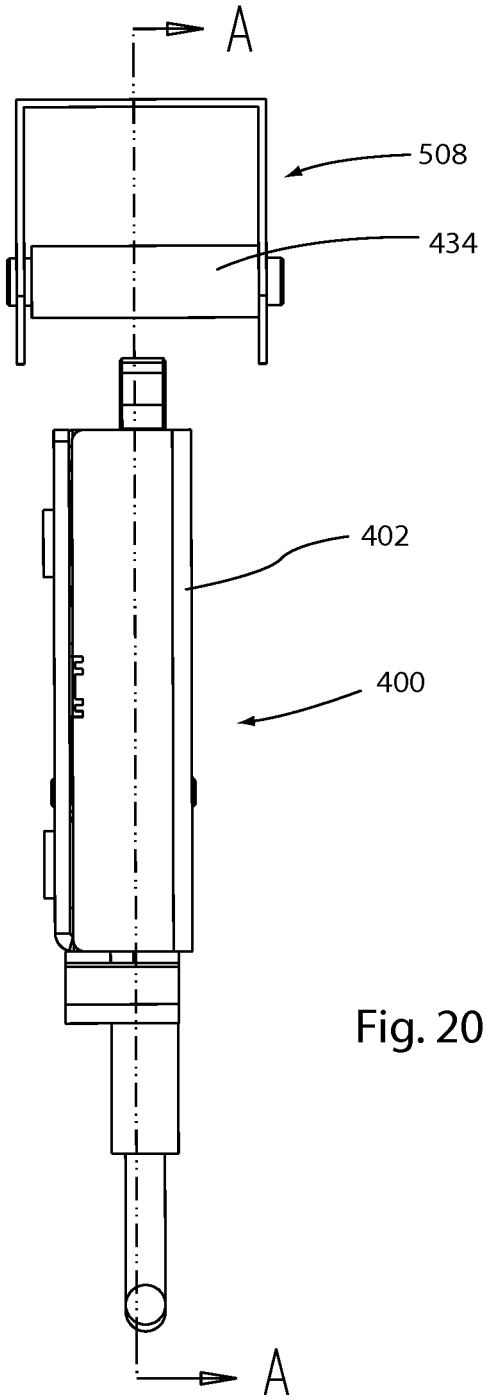
Figure 21:
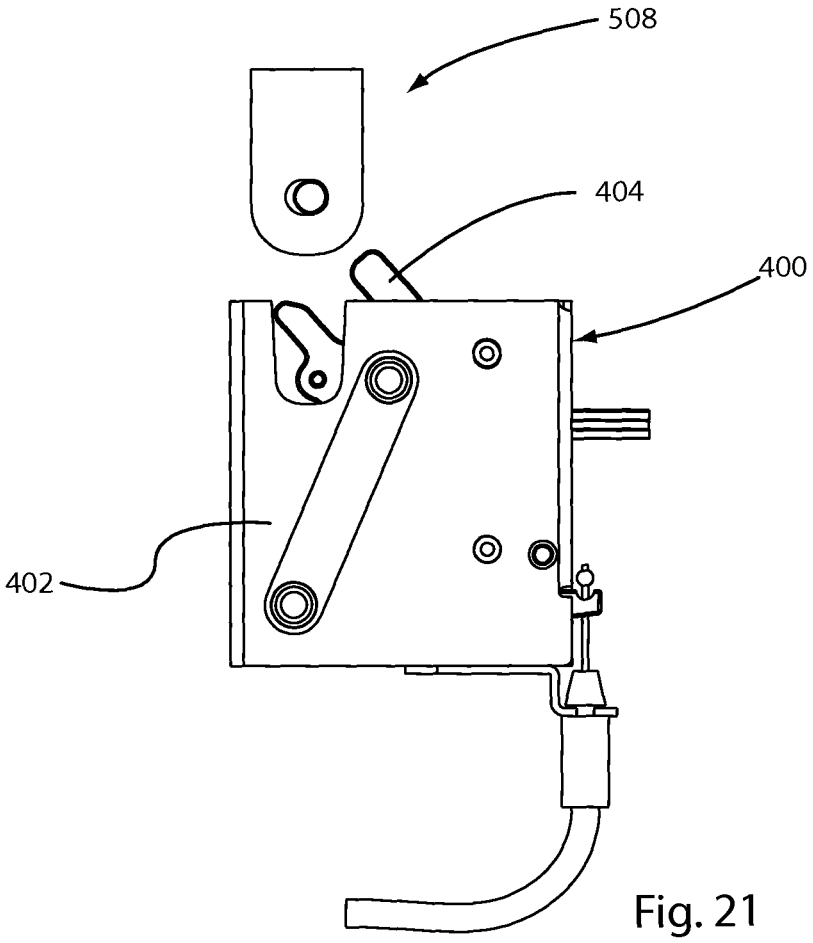
Figure 22:
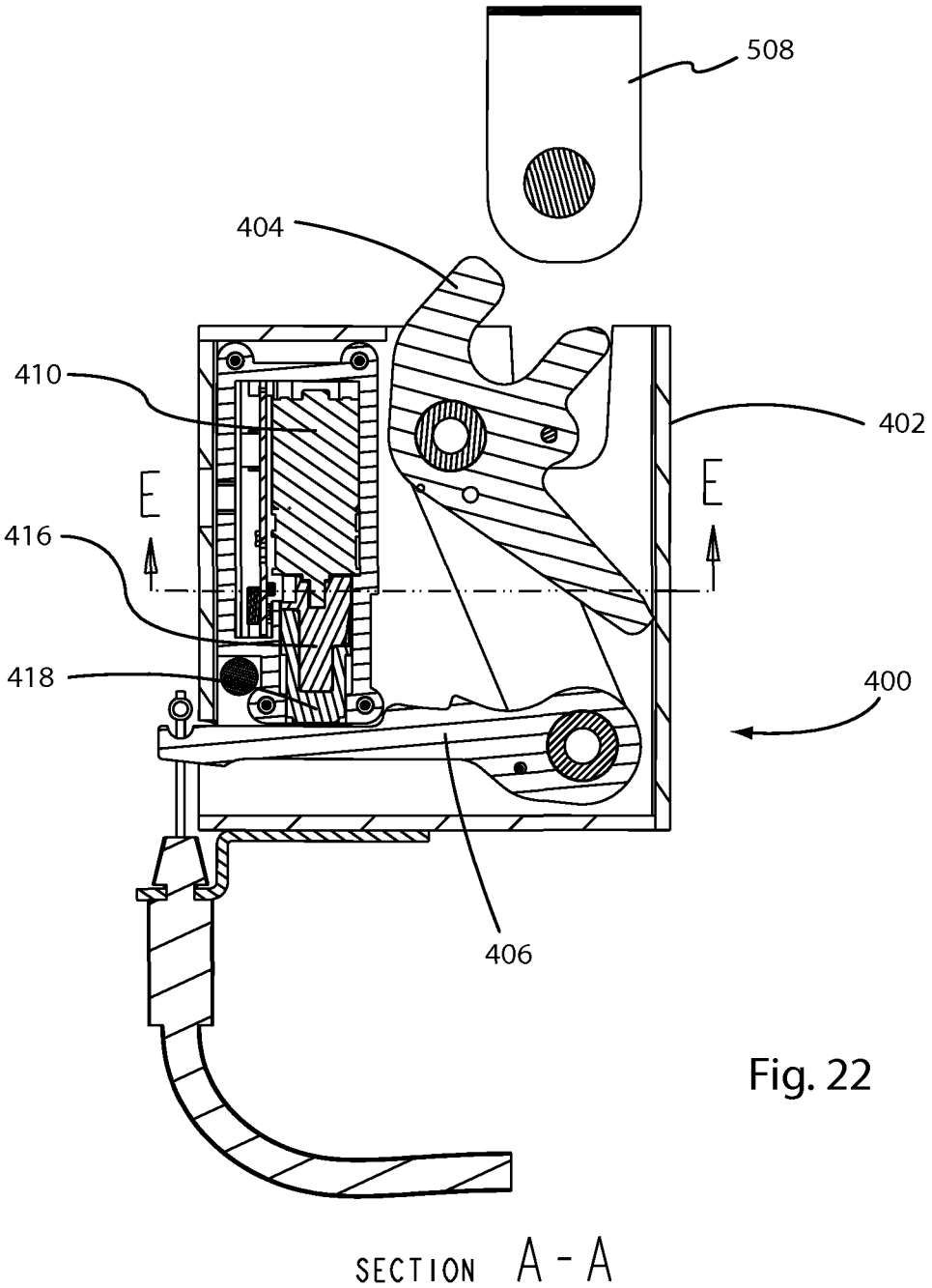
Figure 23:
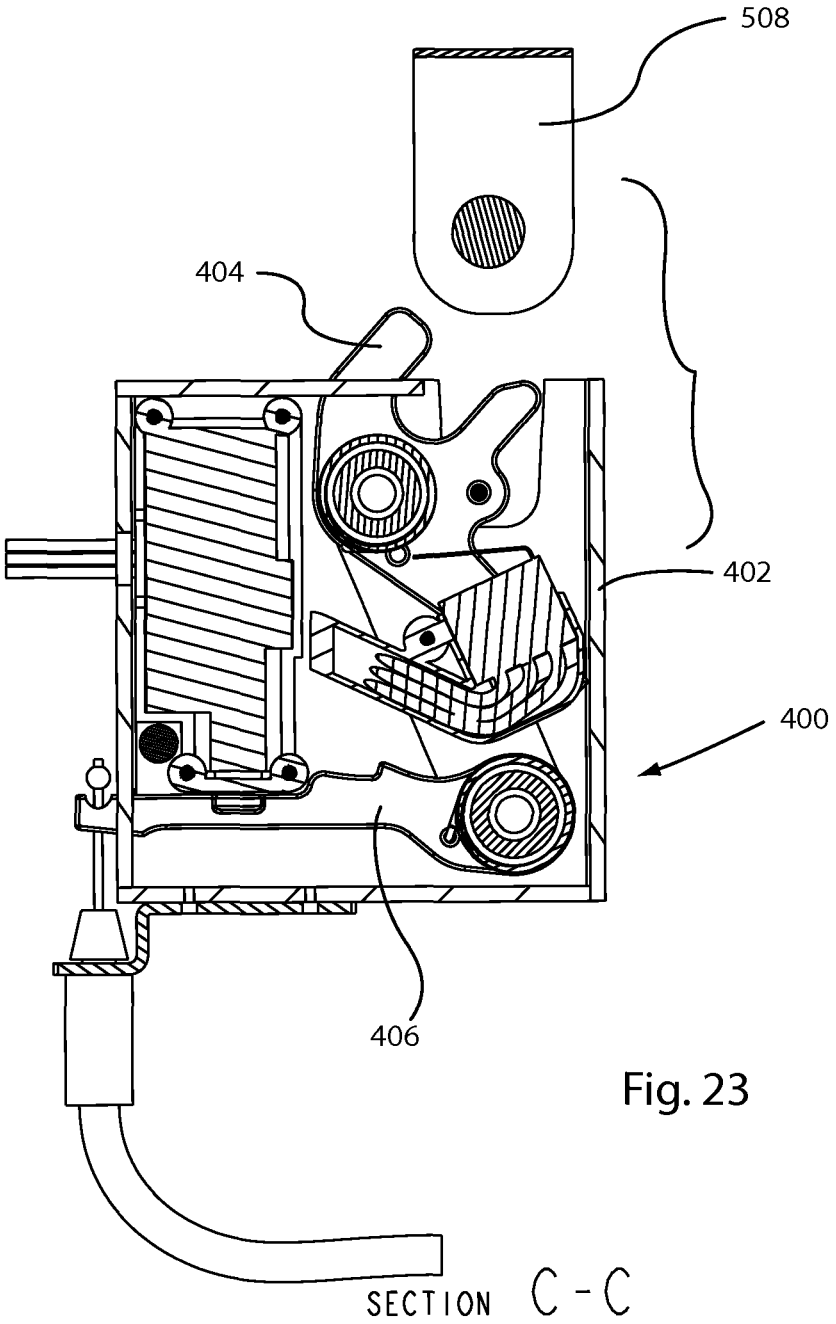
Figure 24:
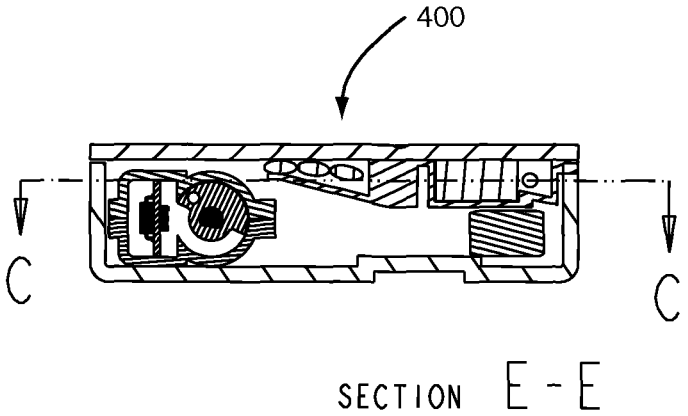
Figure 25:
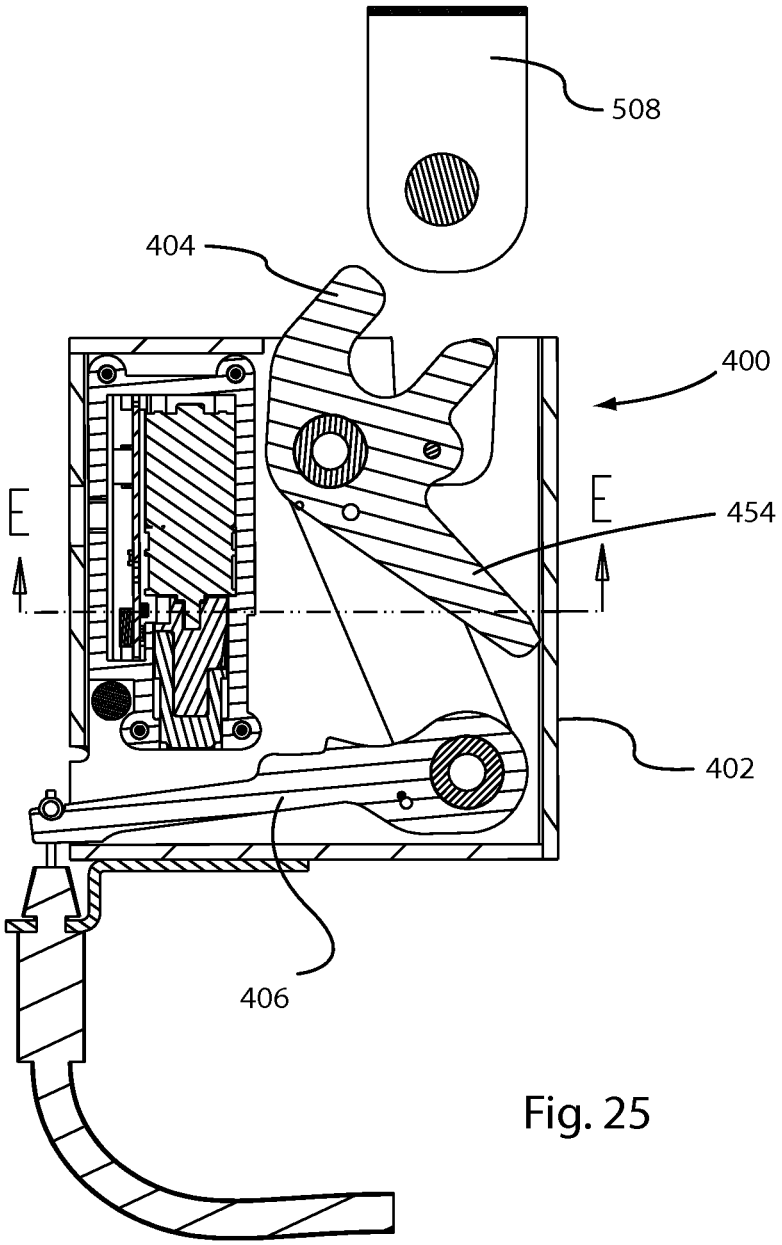
FIG. 25 is a cross sectional view of the latch assembly of FIG. 1 showing the latch in the unlatched configuration with the trigger or catch actuated by cable.
Figure 26:
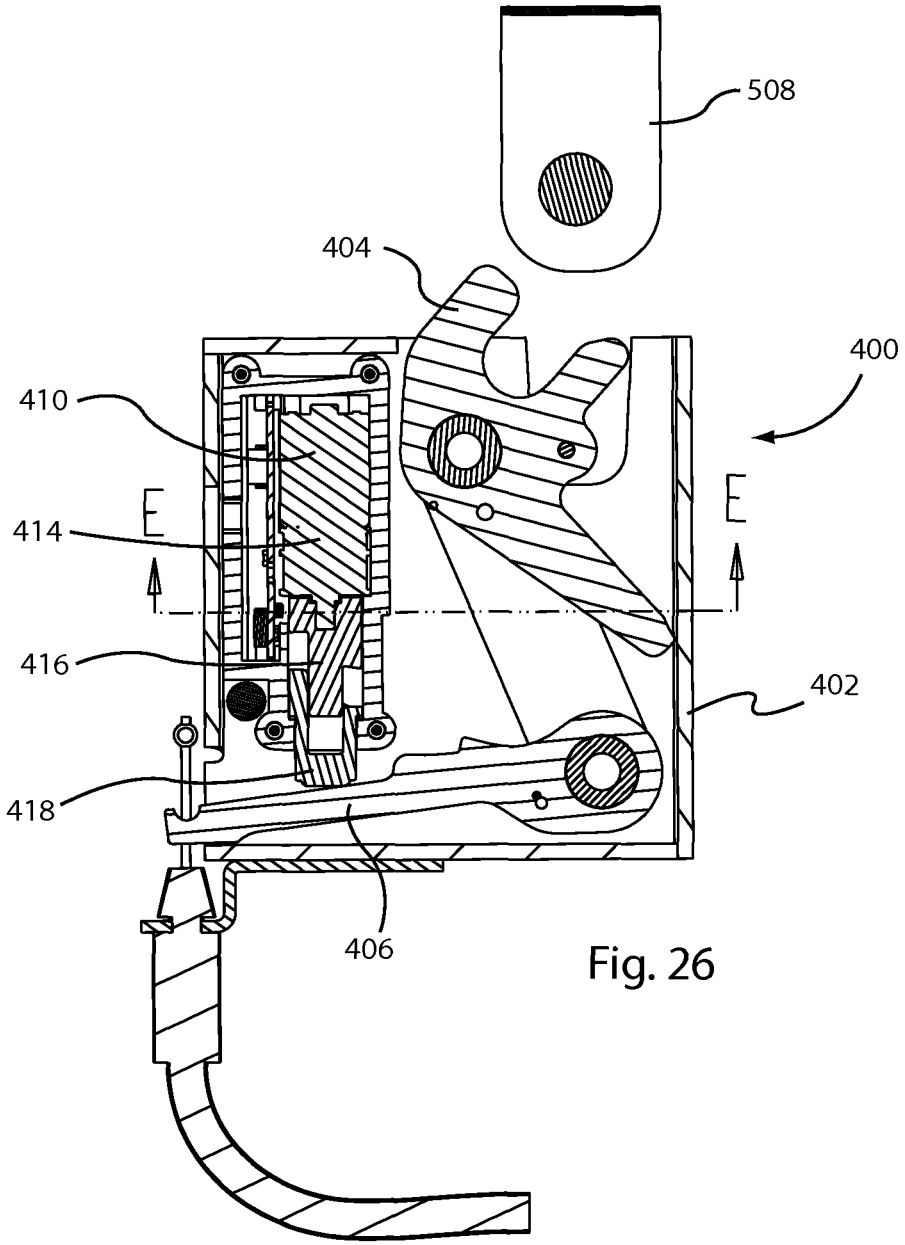
FIG. 26 is a cross sectional view of the latch assembly of FIG. 1 showing the latch in the unlatched configuration with the trigger or catch actuated by the motorized plunger.
Figure 27:
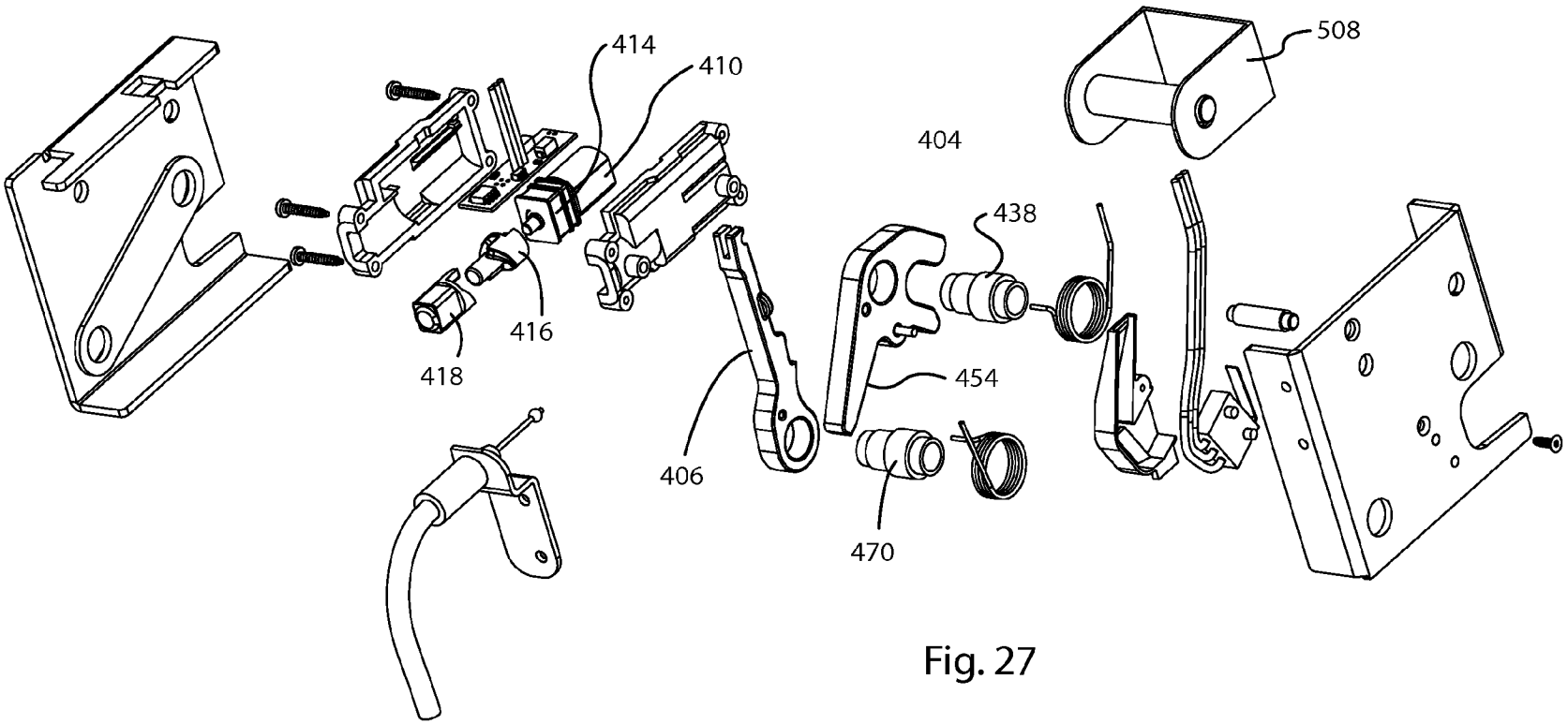
FIG. 27 is an exploded view of the latch assembly of FIG. 1.
Figure 28:
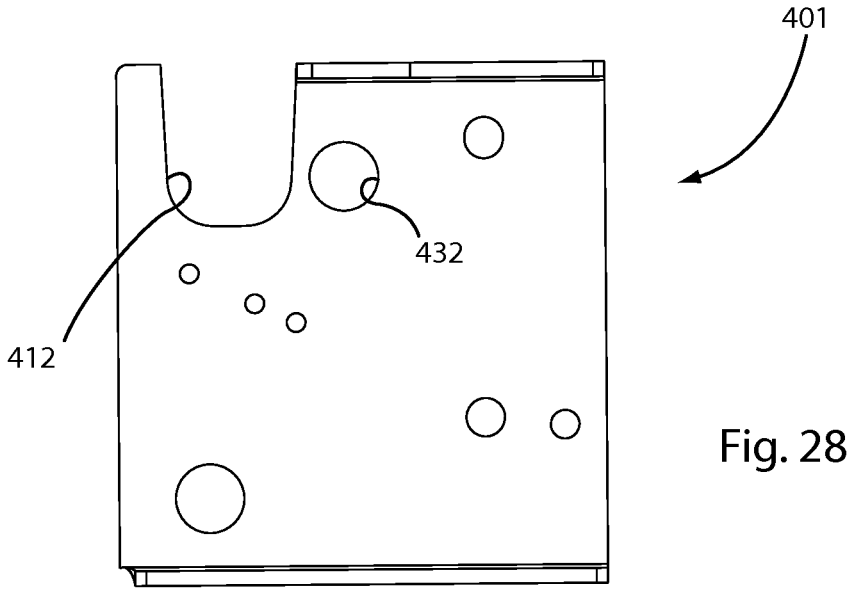
FIGS. 28-29 are views of the cover plate of the housing of the latch assembly of FIG. 1.
Figure 29:
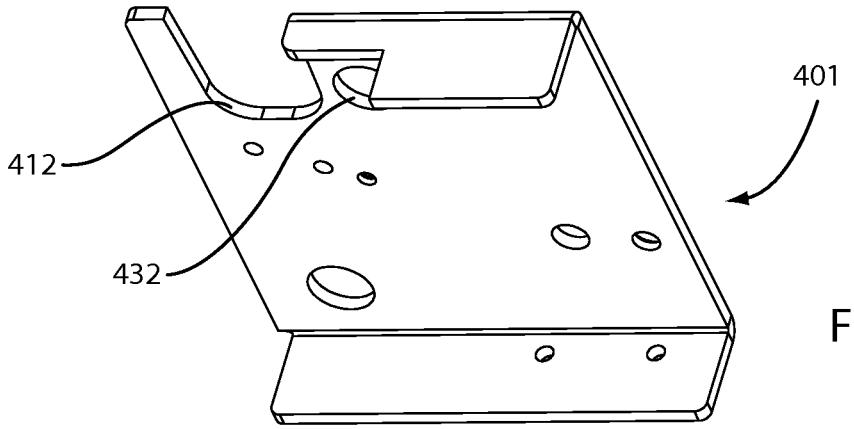
Figure 30:
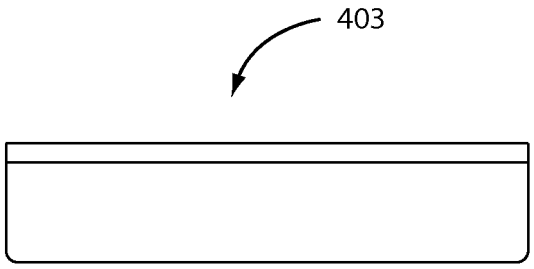
FIGS. 30-34 are views of the base plate of the housing of the latch assembly of FIG. 1.
Figure 31:
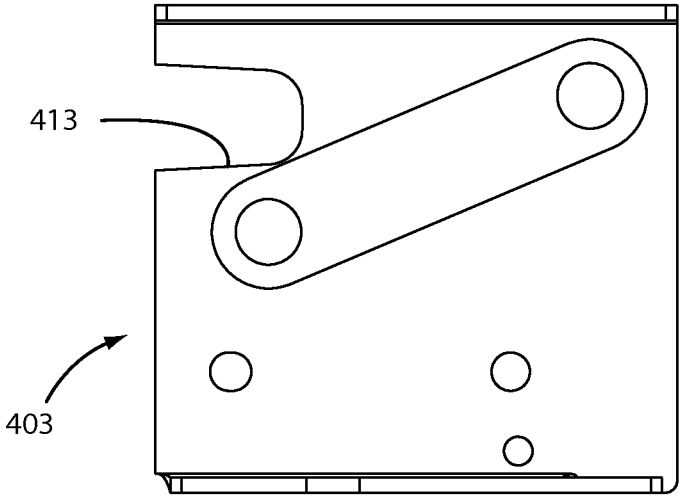
Figure 32:
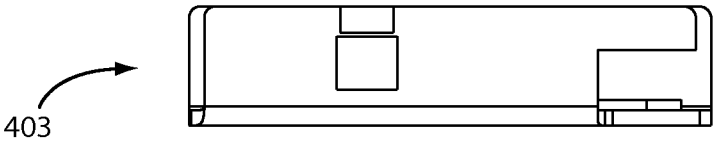
Figure 33:
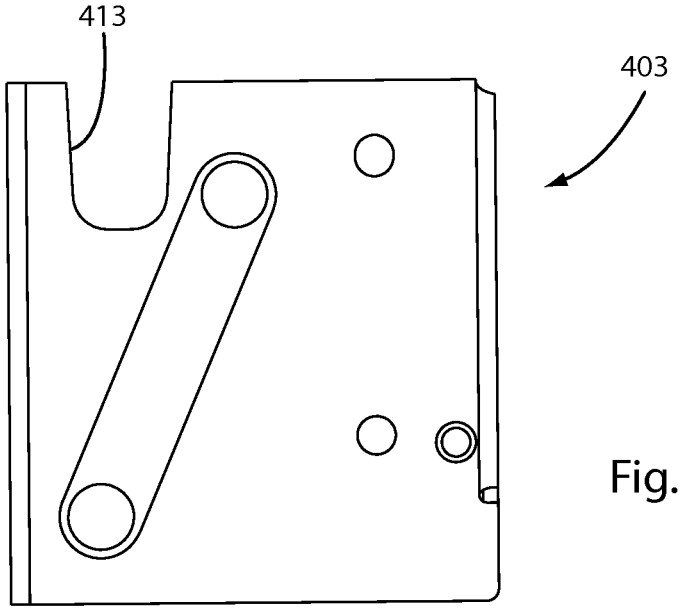
Figure 34:
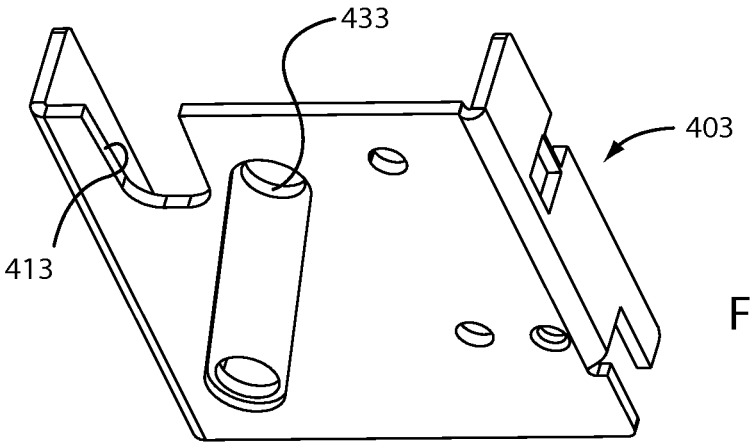
Figure 35:
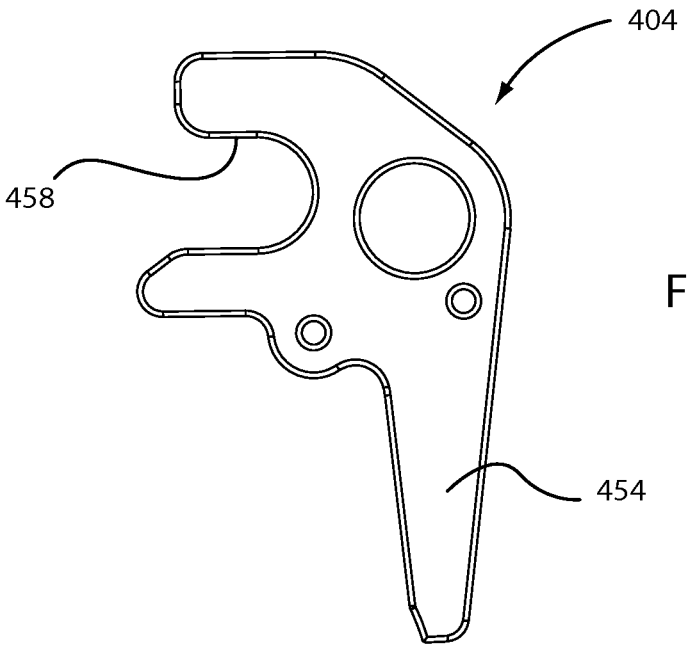
FIGS. 35-39 are views of the rotary pawl of the latch assembly of FIG. 1.
Figure 36:
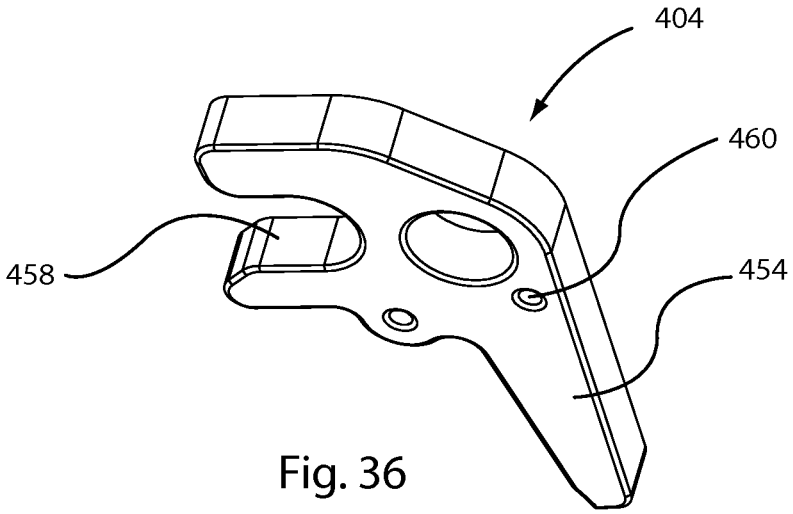
Figure 39:
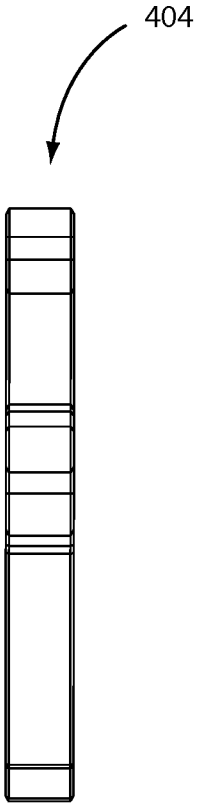
Figure 38:
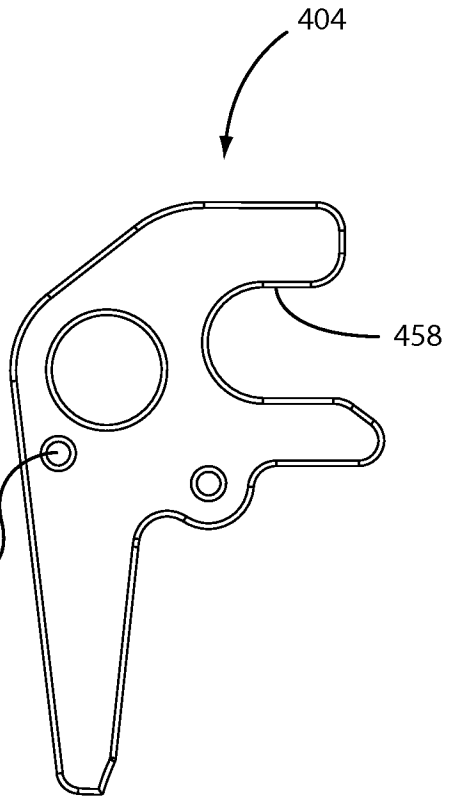
Figure 37:
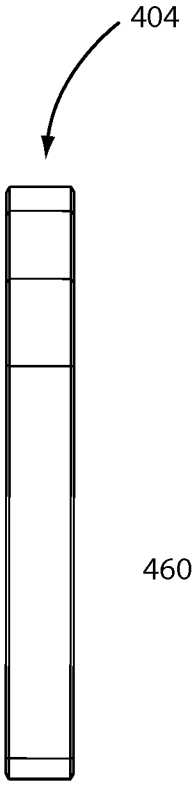
Figure 40:
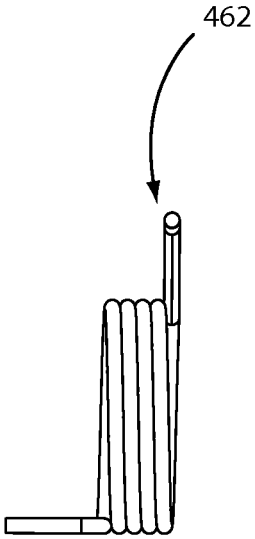
FIGS. 40-44 are views of the pawl spring of the latch assembly of FIG. 1.
Figure 41:
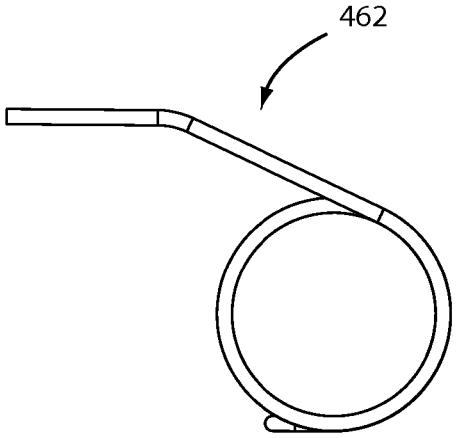
Figure 42:
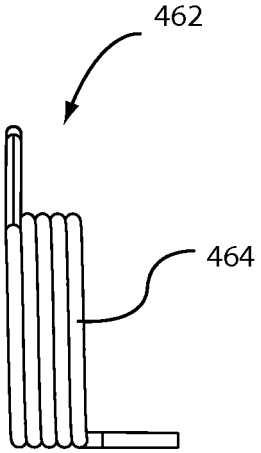
Figure 43:
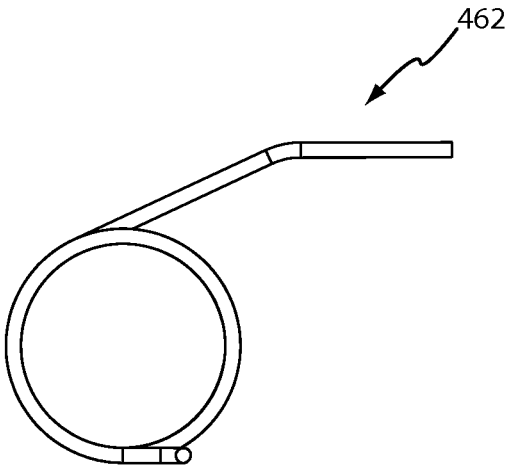
Figure 44:
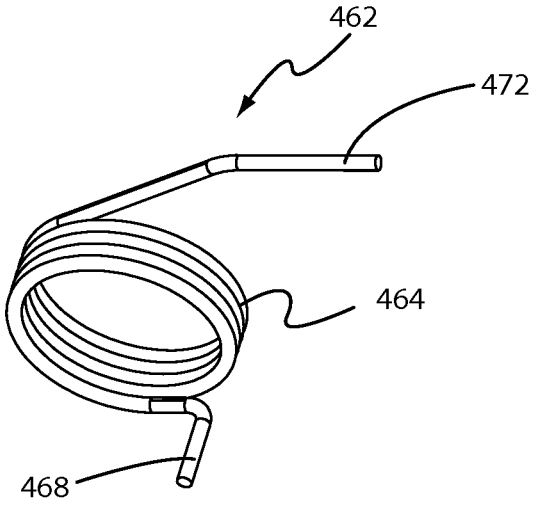
Figure 45:
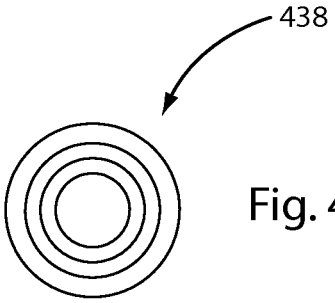
FIGS. 45-48 are views of a pivot shaft of the type used to pivotally support the pawl and the catch of the latch assembly of FIG. 1.
Figure 46:
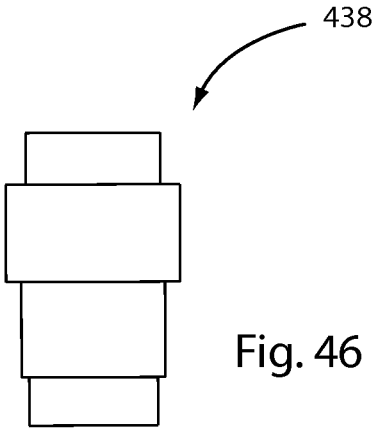
Figure 47:
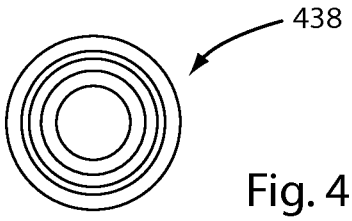
Figure 48:
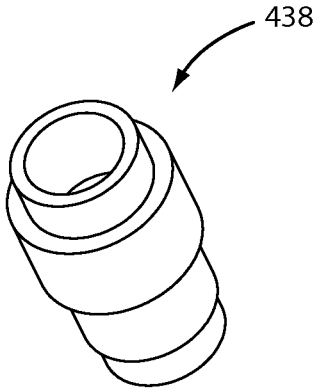
Figure 49:
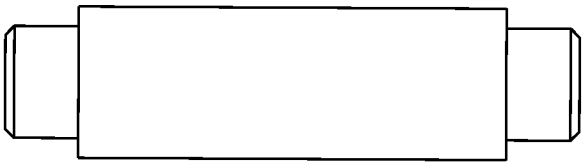
FIGS. 49-50 are views of a spacer bar used to keep the proper distance between the plates of the housing of the latch assembly of FIG. 1.
Figure 50:
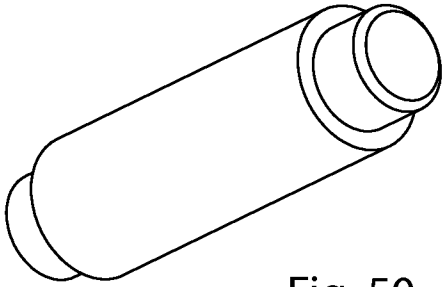
Figure 52:
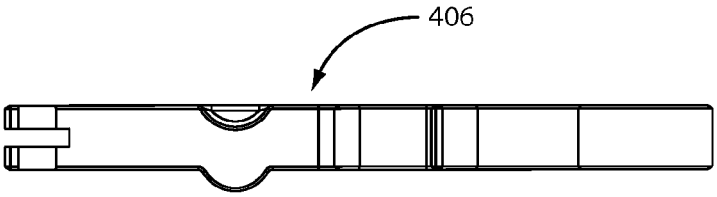
FIGS. 51-57 are views of the catch or trigger of the latch assembly of FIG. 1.
Figure 51:
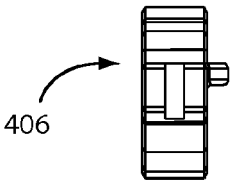
Figure 53:
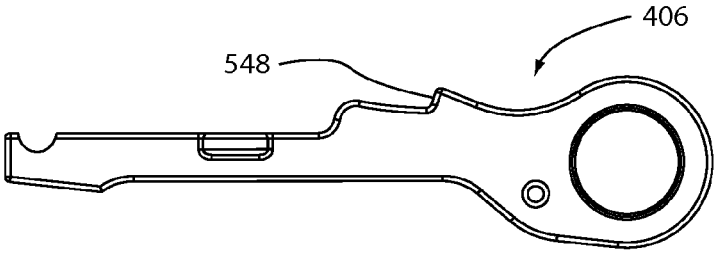
Figure 54:
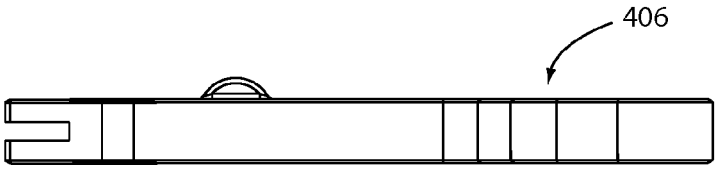
Figure 55:
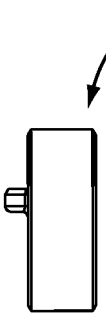
Figure 56:
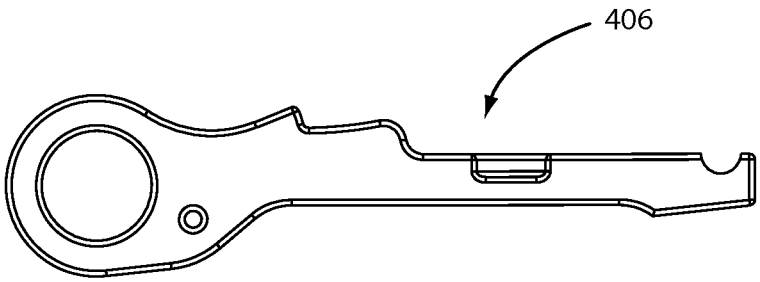
Figure 57:
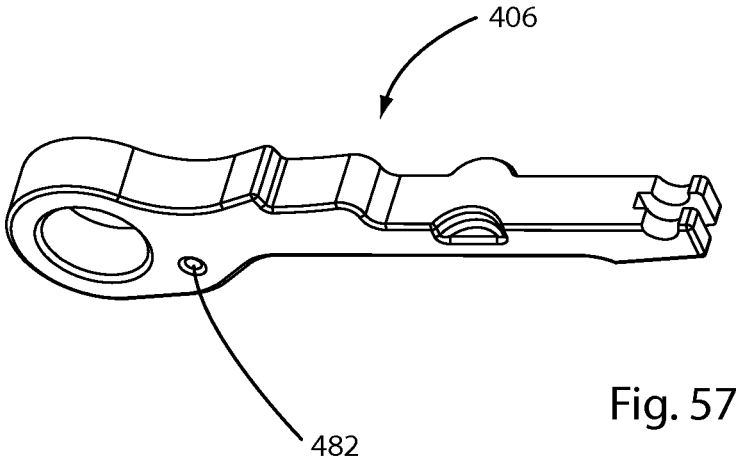
Figure 58:
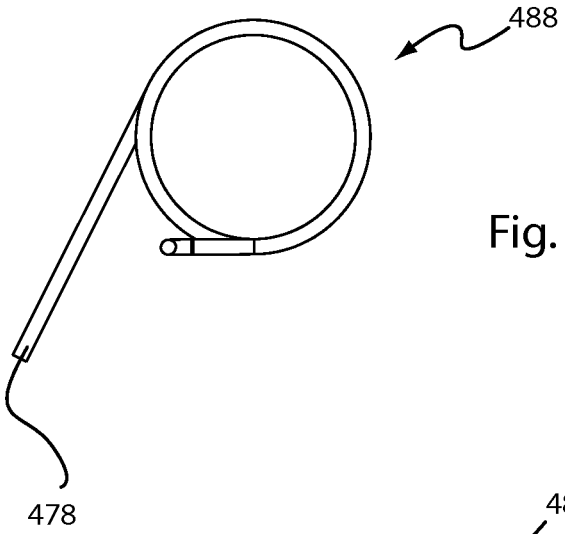
FIGS. 58-61 are views of the catch or trigger spring of the latch assembly of FIG. 1.
Figure 59:
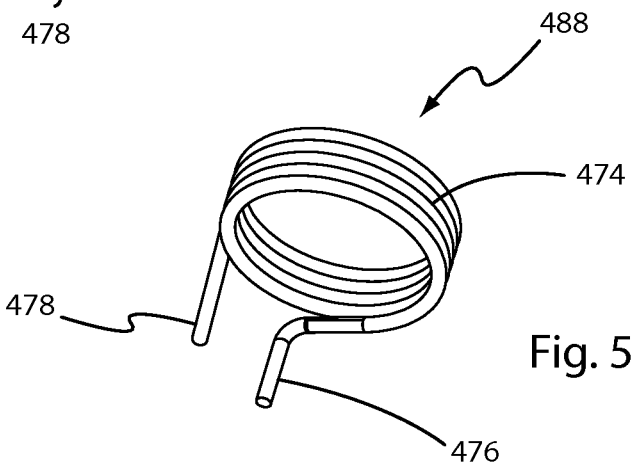
Figure 60:
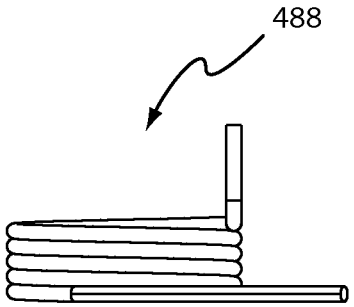
Figure 61:
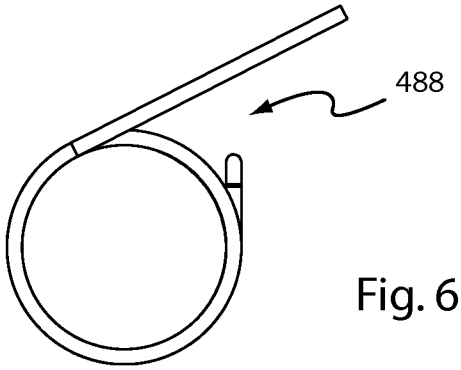
Figure 62:
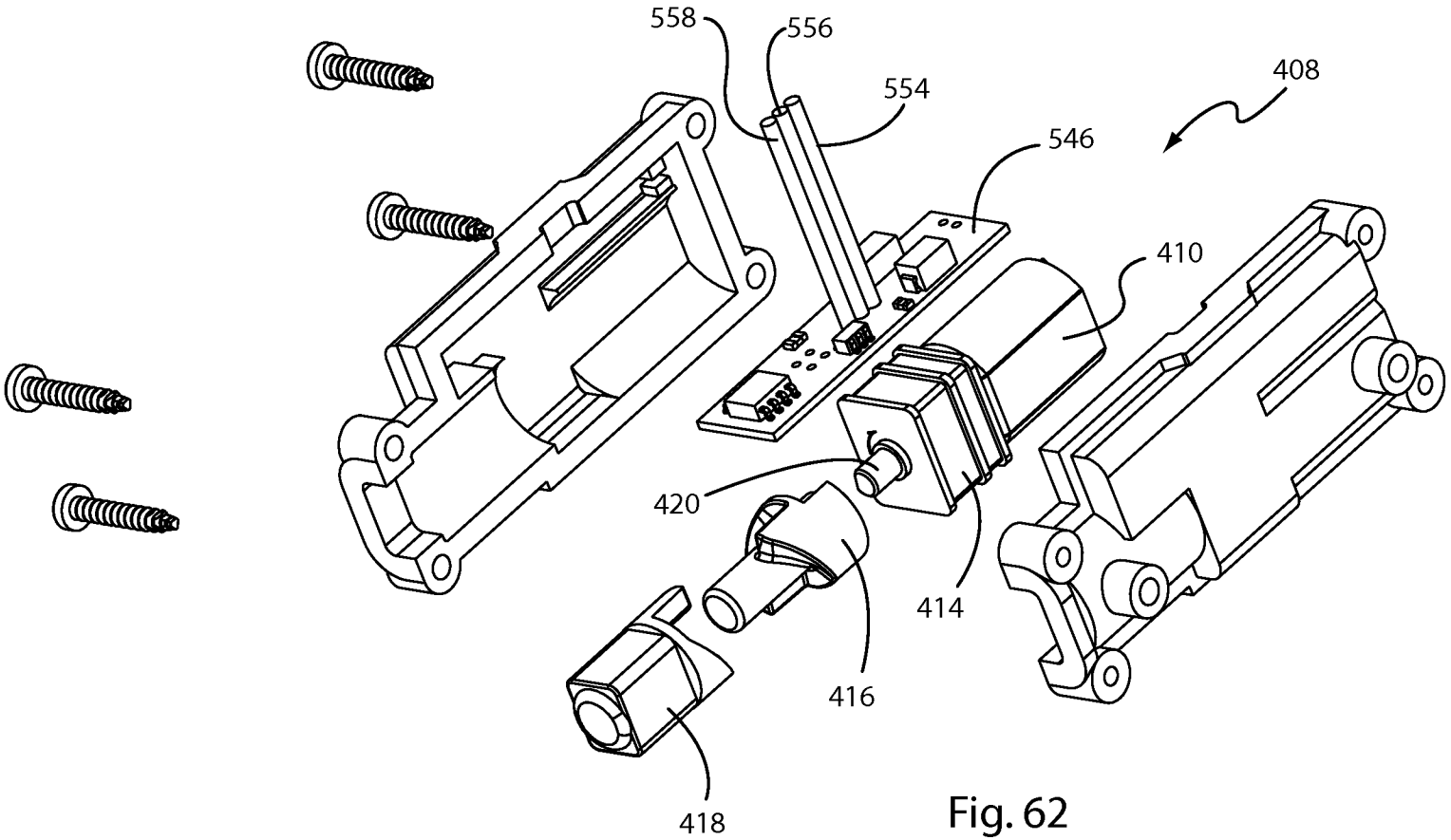
FIG. 62 is an exploded view of the motorized drive mechanism of the latch assembly of FIG. 1.
Figure 64:
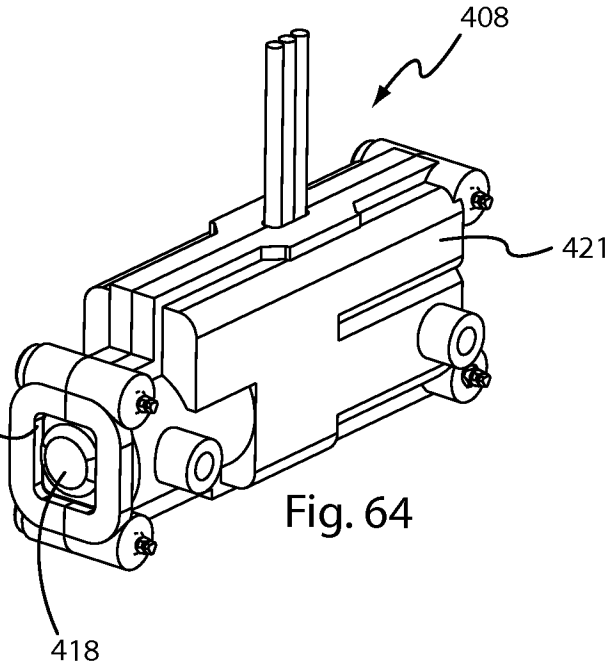
FIGS. 63-67 are views of the motorized drive mechanism of the latch assembly of FIG. 1, shown with the plunger retracted.
Figure 63:
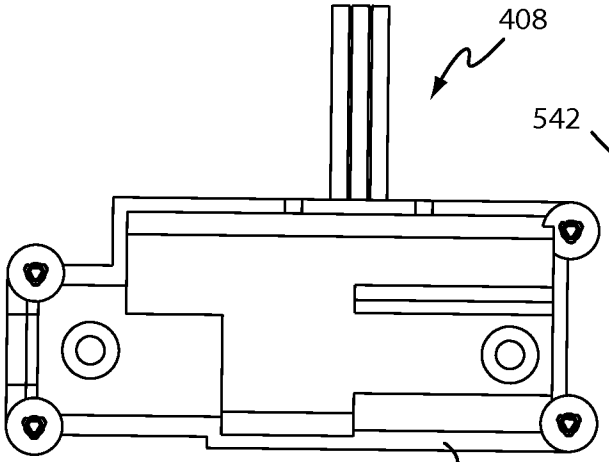
Figure 65:
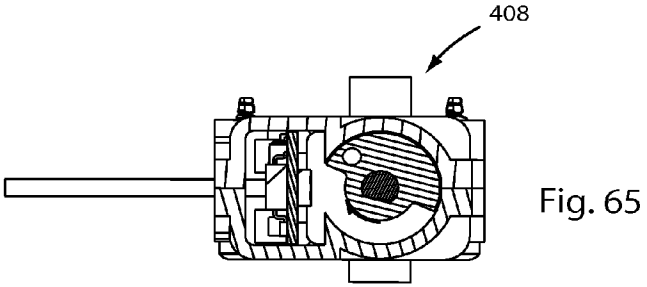
Figure 66:
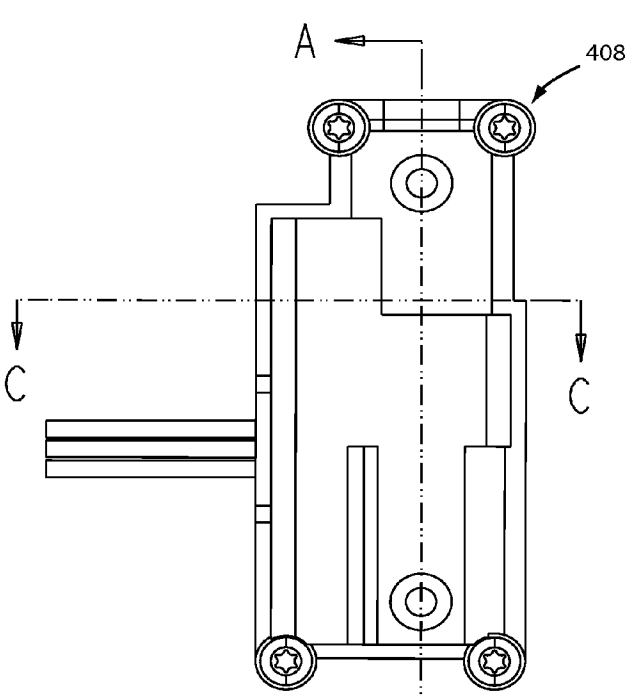
Figure 67:
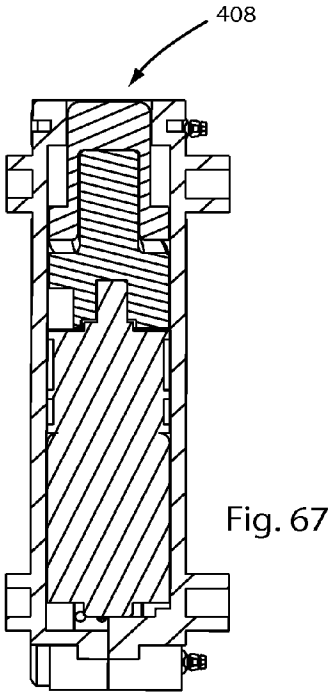
Figure 69:
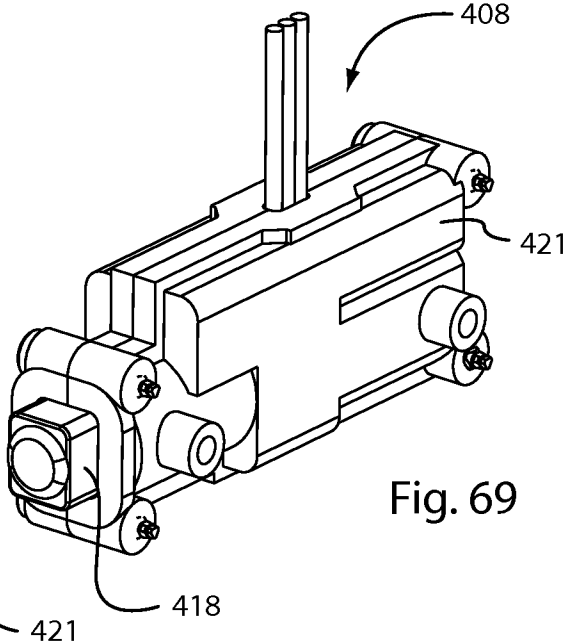
FIGS. 68-72 are views of the motorized drive mechanism of the latch assembly of FIG. 1, shown with the plunger extended.
Figure 68:
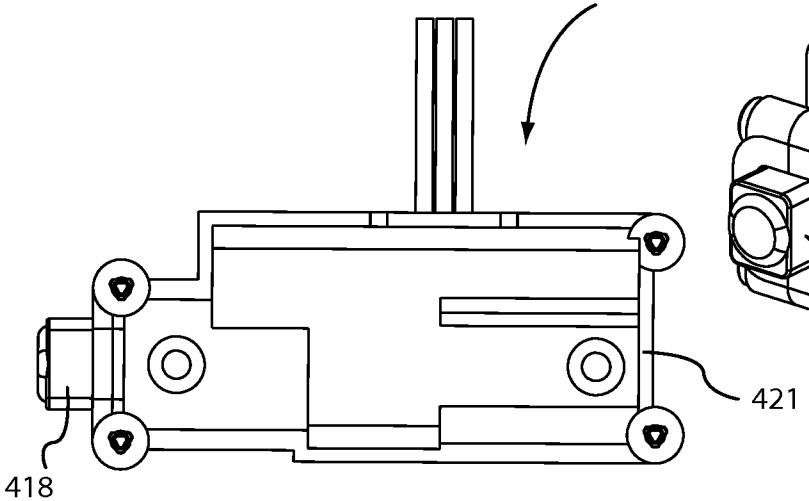
Figure 70:
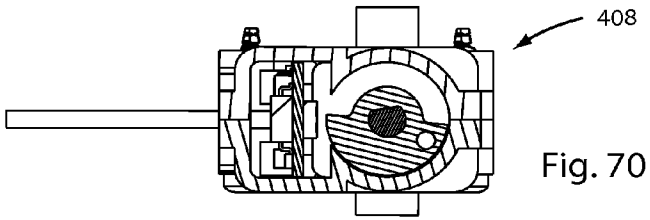
Figure 71:
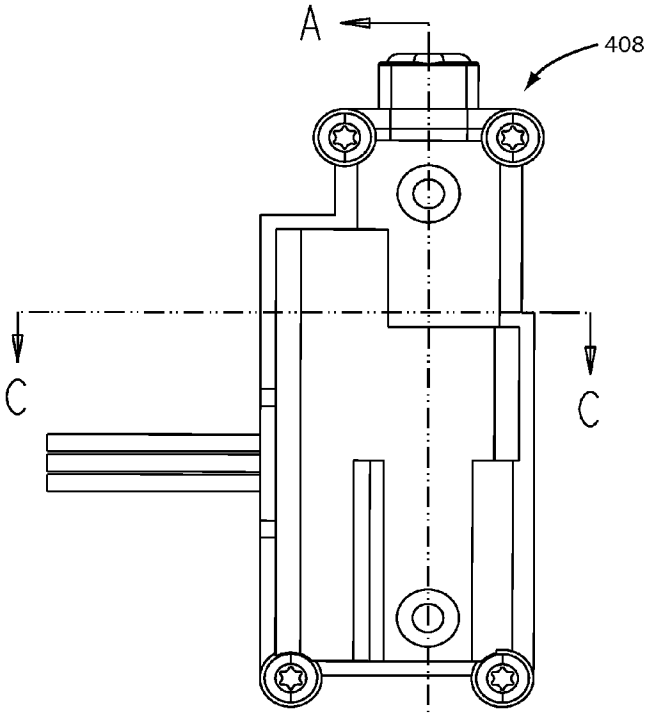
Figure 72:
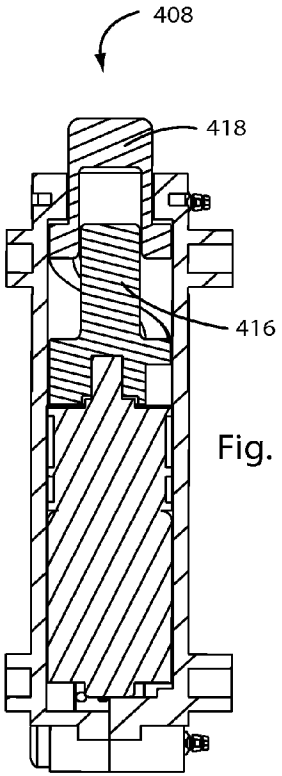
Figure 73:
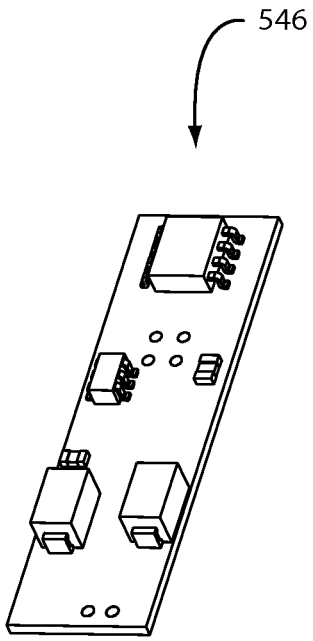
FIG. 73 is a diagrammatic view of the circuit board that controls the motorized drive mechanism of the latch assembly of FIG. 1.
Figure 74:
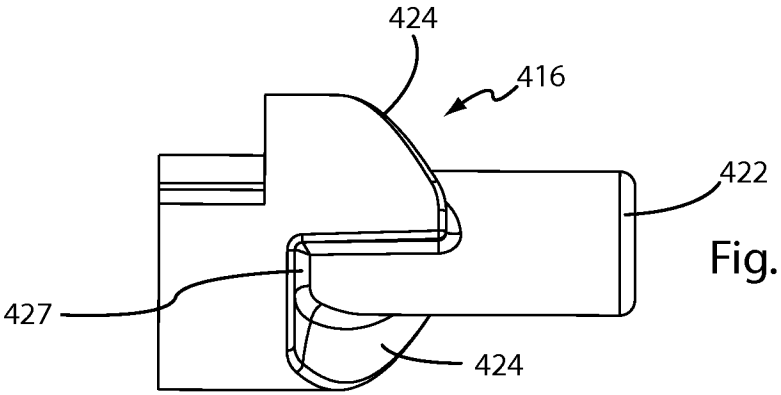
FIGS. 74-80 are views of the cam of the motorized drive mechanism of the latch assembly of FIG. 1.
Figure 76:
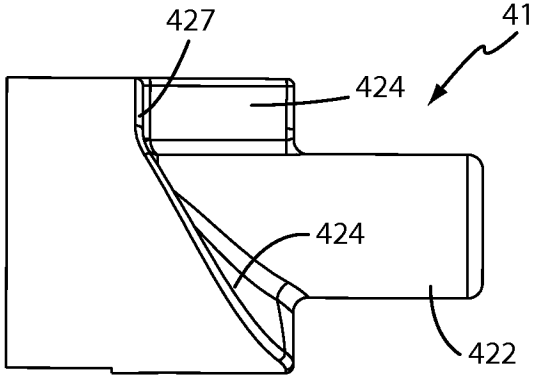
Figure 75:
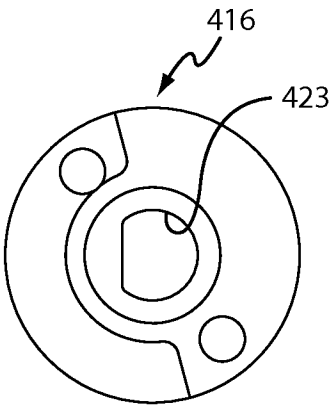
Figure 77:
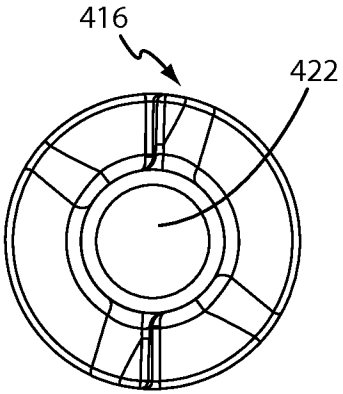
Figure 78:
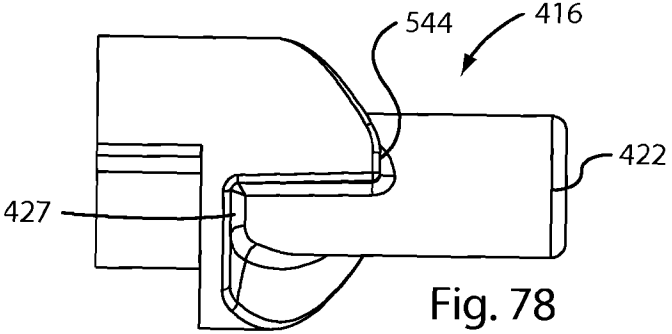
Figure 79:
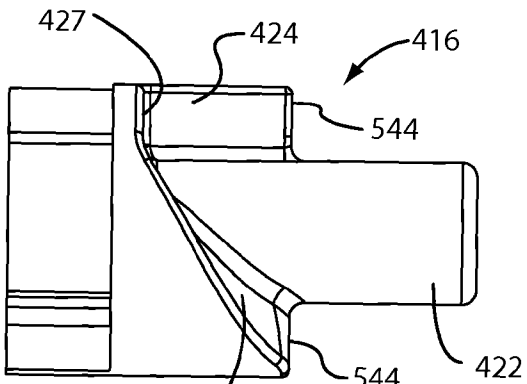
Figure 80:
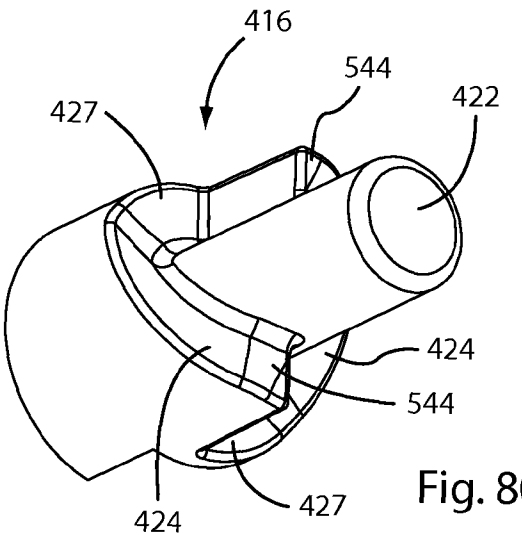
Figure 81:
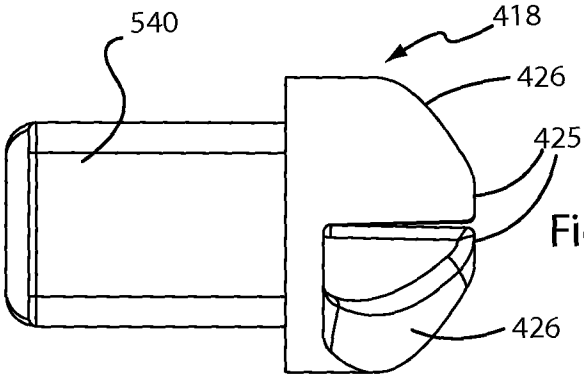
FIGS. 81-87 are views of the plunger of the motorized drive mechanism of the latch assembly of FIG. 1.
Figure 84:
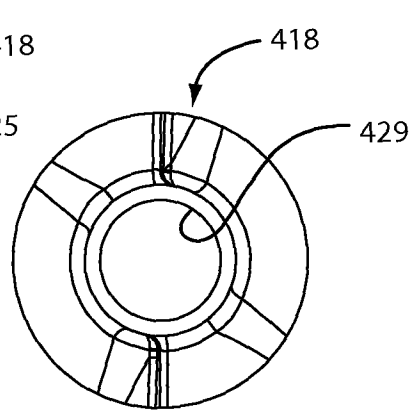
Figure 83:
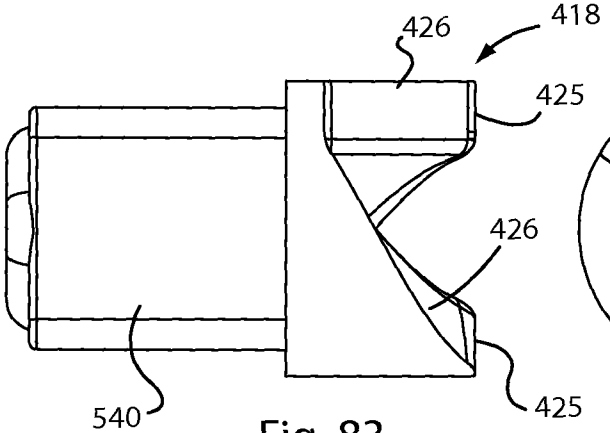
Figure 82:
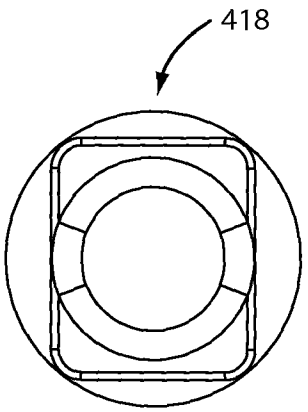
Figure 85:
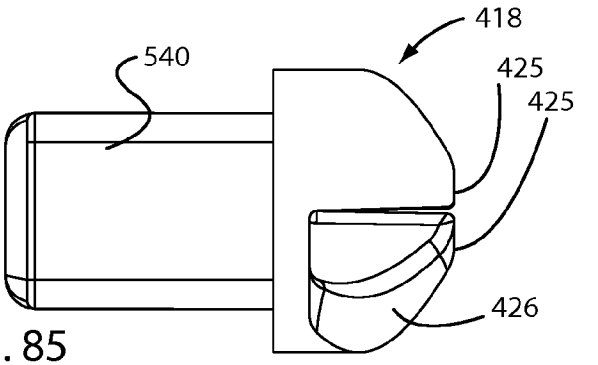
Figure 86:
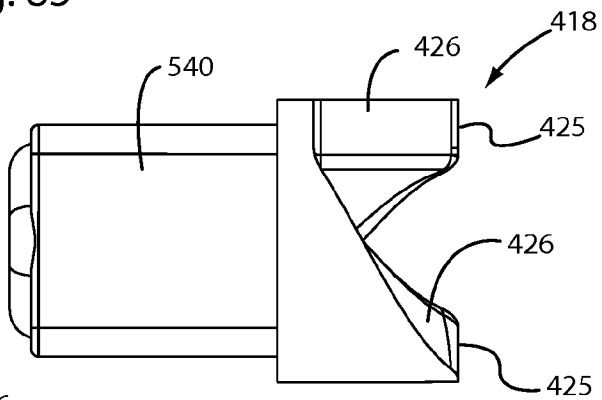
Figure 87:
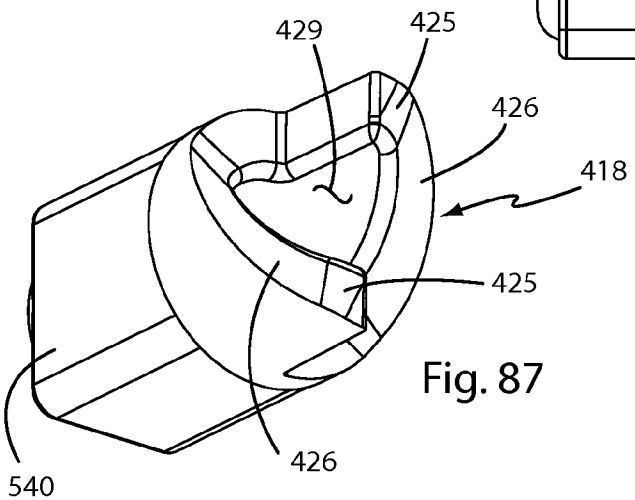
Figure 88:
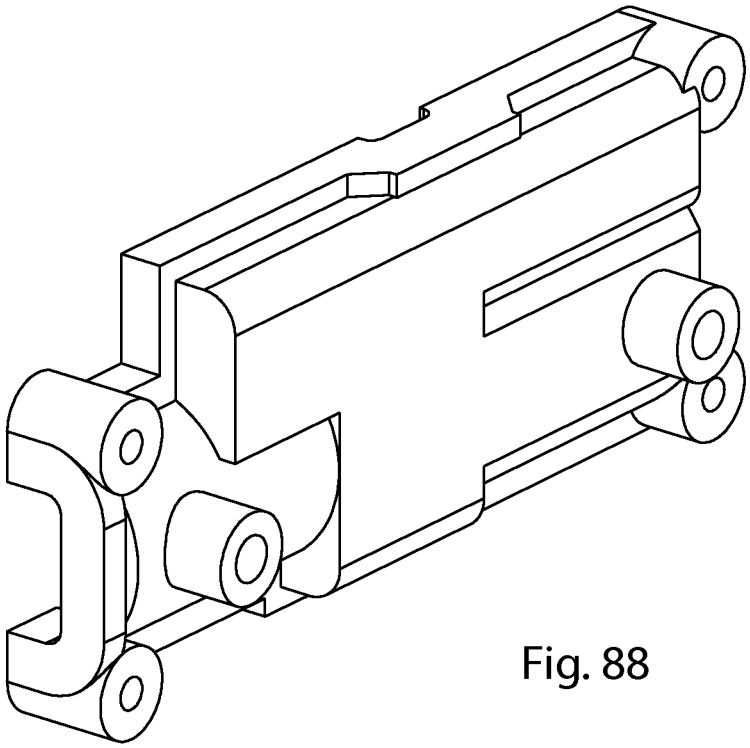
FIGS. 88-89 are views of the first half of the housing of the motorized drive mechanism of the latch assembly of FIG. 1.
Figure 89:
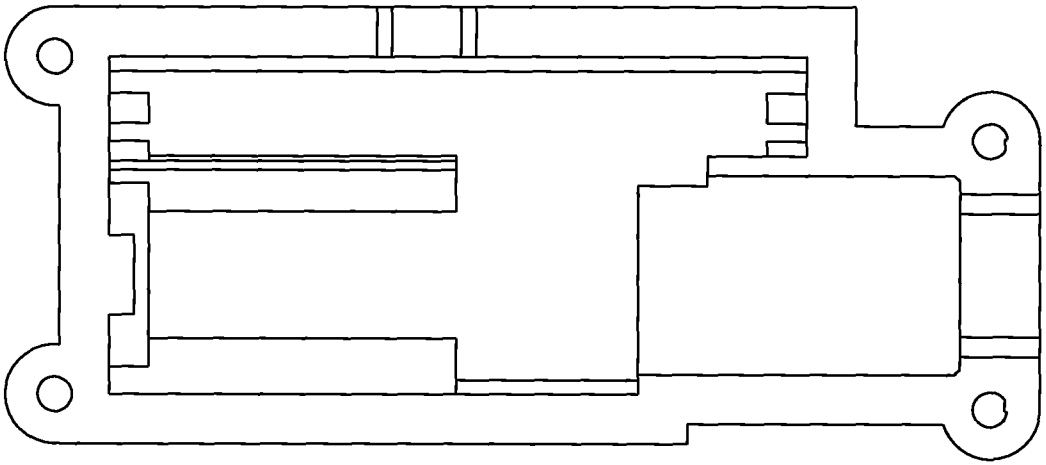
Figure 90:
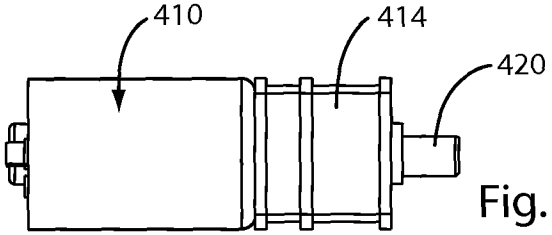
FIGS. 90-96 are views of the motor and gearbox of the motorized drive mechanism of the latch assembly of FIG. 1.
Figure 92:
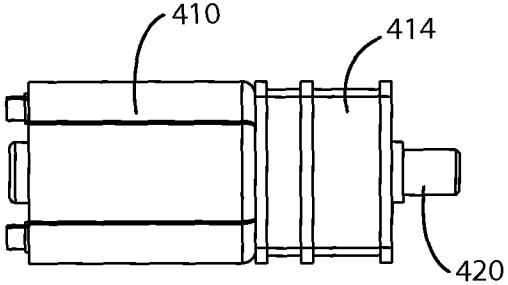
Figure 91:
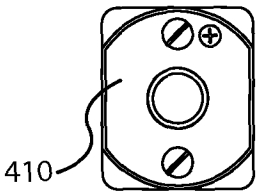
Figure 93:
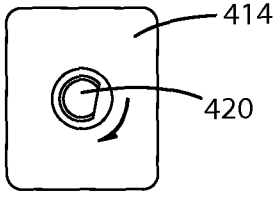
Figure 94:
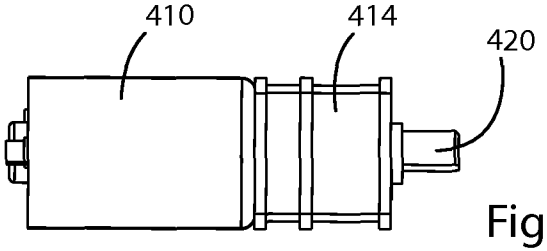
Figure 95:
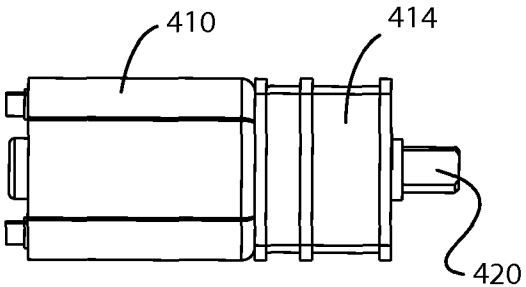
Figure 96:
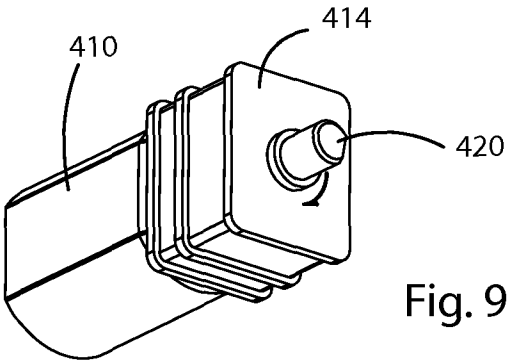
Figure 97:
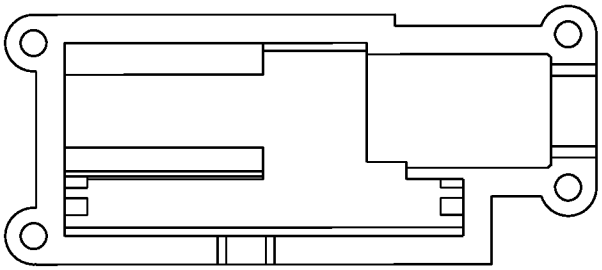
FIGS. 97-98 are views of the second half of the housing of the motorized drive mechanism of the latch assembly of FIG. 1.
Figure 98:
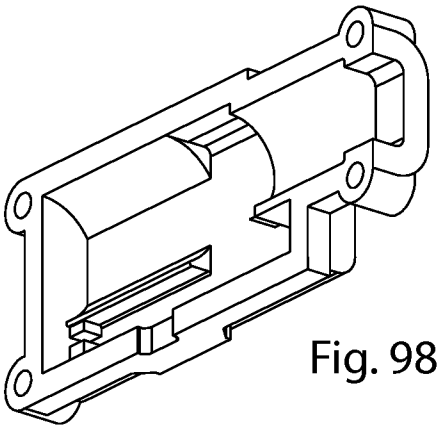

The latch assembly 400 is actuated by energizing the motor 410. The motor 410 may be energized using a remotely located switch (not shown). The plunger 418 is normally in the retracted position when the drawer 500 is secured in the closed position. When the motor 410 is energized, the cam 416 is rotated causing the plunger 418 to be rectilinearly displaced to the extended position. As the plunger 418 moves to the extended position, the plunger impacts the trigger 406 and causes the trigger 406 to move to the disengaged position thereby freeing up the pawl 404 for pivoting. The bias provided by the pawl torsion spring 462 rotates the pawl 404 from its latched or closed position, illustrated in FIG. 9, where the rod-shaped portion 434 of the striker 508 is captured by the pawl slot 458, toward its unlatched position illustrated in FIG. 26. The rotation of the pawl 404 moves the opening of the pawl slot 458 such that the opening of the pawl slot 458 substantially registers with the slots 412, 413 of the housing 402, thus allowing the striker 508 to be disengaged from the pawl 404. The drawer 500 can then be opened by moving it to the open position.

The latch assembly 400 can be mounted on a panel or mounting surface, such as the frame surrounding the opening of the compartment 509, using a variety of well-known fasteners. In this example, the hollow pivot pins of the pawl 404 and of the trigger 406 allow bolts 550, 552 that are fixed to the cabinet to pass through the latch 400. Then nuts (not shown) can be engaged to the bolts 550, 552 to secure the latch 400 to the cabinet. In the illustrative example, the striker 508 is mounted to the drawer 500 such that, as the drawer 500 is closed, the rod-shaped portion 434 of the striker 508 passes through the slots 412, 413 to engage the pawl slot 458.

The control circuit 546 would be programmed to supply electrical current to the motor 410 for a predetermined period of time corresponding to approximately a 180° rotation of the cam 416. Alternatively, the duration of the energizing of the motor can be controlled through feedback. In this alternative, the cam 416 can be painted black on one side and white on the other; each color extending over approximately a 180° of the outer circumference of the cam 416. An optical sensor provided on the circuit board 546 would then detect the color boundary between the light and dark areas and generate a signal to shut off electricity to the motor 410.

The circuit board 546 is interfaced to the remote switch and power supply by three wires 554, 556, 558. The circuit board **546*a* has a two-wire interface using wires 554*a* and 556*a*. The choice would depend on the ultimate application for which the end user intends to use the latch 400. Also a circuit board having both types of interface can be provided for the latch 400**.

The latch 400 may also include a micro switch 532 tripped by the pin 560 to provide a "door ajar" signal to a remote control panel.

As a mechanical backup the trigger 406 can be moved to the disengaged position by the cable 562.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. An electrically operated actuator assembly comprising:

a housing;

a motor supported by said housing;

a plunger having a longitudinal axis and supported by said housing such that said plunger is movable between an extended position and a retracted position while said plunger is prevented from rotation about its longitudinal axis relative to said housing; and a cam operatively connected to said motor such that said cam rotates continuously in a direction of rotation when said motor is energized, said cam having at least a first cam surface and a second cam surface, each of said first cam surface and said second cam surface being in the form of a cam ramp having an apex and a bottom, wherein said bottom of said second cam surface immediately follows said apex of said first cam surface as said cam rotates in said direction of rotation, wherein said plunger has at least a pair of plunger ramps, said plunger ramps each having an apex, each of said plunger ramps engaging a respective one of said first cam surface and said second cam surface such that each of said plunger ramps rides up said respective one of said first cam surface and said second cam surface to move said plunger from said retracted position toward said extended position in response to rotation of said cam, and wherein said apex of each of said plunger ramps rides over said apex of said respective one of said first cam surface and said second cam surface to register with said bottom of another one of said first cam surface and said second cam surface as said cam continues to rotate in said direction of rotation in order to free said plunger to move back to said retracted position such that each time said motor is energized said plunger can move from said retracted position to said extended position and back to said retracted position as said cam performs one continuous rotational movement.

2. The actuator assembly of claim 1, wherein said at least a first cam surface and a second cam surface is exactly said first cam surface and said second cam surface.

3. The actuator assembly of claim 2, wherein each of said plunger ramps has a bottom, and said plunger ramps mate with said cam ramps when said motor is not energized such that said apex of each of said plunger ramps seats against said bottom of a respective one of said first cam surface and said second cam surface.

4. The actuator assembly of claim 3, wherein when said motor is initially energized, said cam rotates causing said plunger ramps to ride up said first cam surface and said second cam surface such that said plunger will move from its retracted position toward its extended position.

5. The actuator assembly of claim 4, wherein when said motor is energized, said cam continues to rotate at least until said bottom of each of said first cam surface and said second cam surface is in registry with said apex of a respective one of said plunger ramps such that said plunger is free to move back to said retracted position.

6. The actuator assembly of claim 5, wherein said electrically operated actuator assembly further comprises:

a reduction gear system that operatively connects said motor to said cam and that reduces a torque output required of said motor.

7. A latch assembly for releasably securing a first member in a closed position relative to a second member, one of said first member and said second member having a keeper in a fixed positional relationship therewith, the latch assembly comprising:

a latch housing;

a pawl pivotally attached to the latch housing and being movable between a closed position and an open position, the pawl being provided with a torsion spring member that biases the pawl toward the open position;

a catch pivotally supported by said latch housing and being movable between an engaged position and a disengaged position, said catch engaging said pawl at an engagement position when said pawl is in said closed position and said catch is in said engaged position; and the electrically operated actuator assembly according to claim 1 for selectively moving said catch out of engagement with said pawl, wherein the actuator assembly is supported by said latch housing, wherein said plunger pushes said catch to release said pawl from its closed position as said plunger moves toward said extended position.

8. The latch assembly according to claim 7, wherein said catch forms an elongated lever that is pivotally supported in said latch housing near one of its ends, said catch engages said pawl at a point intermediate a pivot axis of said catch and a location on said catch where said plunger contacts said catch and said location on said catch where said plunger contacts said catch is as far away as possible from said pivot axis of said catch, such that said catch provides a mechanical advantage to said plunger due to said catch forming said elongated lever in order to reduce a torque output required of said motor.

9. The latch assembly according to claim 8, wherein said pawl has an elongated pawl arm and said pawl arm is engaged by said catch to retain said pawl in said closed position to thereby further reduce said torque output required of said motor.

10. A latch assembly for releasably securing a first member in a closed position relative to a second member, one of said first member and said second member having a keeper in a fixed positional relationship therewith, the latch assembly comprising:

a latch housing;

a pawl pivotally attached to the latch housing and being movable between a closed position and an open position, the pawl being provided with a torsion spring member that biases the pawl toward the open position;

a catch pivotally supported by said latch housing and being movable between an engaged position and a disengaged position, said catch engaging said pawl at an engagement position when said pawl is in said closed position and said catch is in said engaged position; and an actuator assembly for selectively moving said catch out of engagement with said pawl, wherein the actuator assembly is supported by said latch housing, wherein said actuator assembly includes a plunger that pushes said catch to release said pawl from its closed position as said plunger moves toward an extended position, and wherein said catch forms an elongated lever that is pivotally supported in said latch housing near one of its ends, said catch engages said pawl at a point intermediate a pivot axis of said catch and a location on said catch where said plunger contacts said catch and said location on said catch where said plunger contacts said catch is as far away as possible from said pivot axis of said catch, such that said catch provides a mechanical advantage to said plunger due to said catch forming said elongated lever in order to reduce a torque output required of said motor.

11. The latch assembly according to claim 10, wherein said pawl has an elongated pawl arm and said pawl arm is engaged by said catch to retain said pawl in said closed position to thereby further reduce said torque output required of said motor.

* * * * *